US008335458B2

(12) United States Patent
Ino et al.

(10) Patent No.: US 8,335,458 B2
(45) Date of Patent: Dec. 18, 2012

(54) IMAGE FORMING APPARATUS

(75) Inventors: Kazushi Ino, Suntou-gun (JP); Satoshi Nakashima, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 302 days.

(21) Appl. No.: 12/769,128

(22) Filed: Apr. 28, 2010

(65) Prior Publication Data

US 2010/0278560 A1 Nov. 4, 2010

(30) Foreign Application Priority Data

May 1, 2009 (JP) ..... 2009-112072

(51) Int. Cl.
*G03G 15/00* (2006.01)

(52) U.S. Cl. ..... 399/167

(58) Field of Classification Search ..... 399/167
See application file for complete search history.

(56) References Cited

U.S. PATENT DOCUMENTS

| | | | | |
|---|---|---|---|---|
| 7,983,600 | B2 * | 7/2011 | Abe et al. | 399/167 |
| 2003/0152402 | A1 * | 8/2003 | Ehara et al. | 399/167 |

FOREIGN PATENT DOCUMENTS

| | | | | |
|---|---|---|---|---|
| JP | 63-11937 | A | | 1/1988 |
| JP | 6-324547 | A | | 11/1994 |
| JP | 7-92761 | A | | 4/1995 |
| JP | 2003177632 | A | * | 6/2003 |
| JP | 2009063697 | A | * | 3/2009 |

* cited by examiner

*Primary Examiner* — Quana M Grainger
(74) *Attorney, Agent, or Firm* — Fitzpatrick, Cella, Harper & Scinto

(57) ABSTRACT

An image forming apparatus includes first and second drums subjected to image formation by exposure to light at exposure positions to form latent images and then transferring toner images, formed by developing the latent images with toner, onto a transfer material at transfer positions; first and second gears provided coaxially and integrally with the drums; a driving source for rotationally driving the drums; and a branch gear, meshable with the first and second gears at first and second mesh points, for transmitting a driving force from the driving source to the first and second gears. A sum of a time of movement of a portion of the branch gear located at the first mesh point to the second mesh point and a time of integer-time rotation of the branch gear is equal to a time of movement of the transfer material from the transfer position of the first drum to that of the second drum.

8 Claims, 10 Drawing Sheets

IMAGE FORMING APPARATUS

FIELD OF THE INVENTION AND RELATED ART

The present invention relates to a multi-color image forming apparatus such as a copying machine, a printer, or a facsimile machine.

As an electrophotographic image forming apparatus, a tandem-type image forming apparatus for effecting full-color image formation has been conventionally used. The tandem-type image forming apparatus includes a plurality of image forming portions. For this reason, the image forming apparatus has been accompanied with a problem that movement non-uniformity or the like of a plurality of photosensitive drums or a conveyer belt occurs separately for each color due to mechanical accuracy or the like and color images do not coincide with each other, when the images are superposed, to result in an occurrence of color misregistration. The color misregistration includes those of two types consisting of stationary color misregistration and non-stationary color misregistration. The stationary color misregistration occurs due to deviation or the like of a mounting position of a laser scanner or the like for each color. The non-stationary color misregistration occurs due to rotational speed fluctuation or the like of the photosensitive drums or a driving roller and the like of the conveyer belt.

In order to suppress the non-stationary color misregistration, there is need to prevent a frequency fluctuation component of a driving system including the plurality of the photosensitive drums and a transfer belt from generating on the image. In Japanese Laid-Open Patent Application (JP-A) Sho 63-11937, the plurality of photosensitive drums for alleviating image deterioration by the frequency fluctuation component is driven by a common driving source and the photosensitive drums are disposed so that a time interval in which the transfer belt passes through adjacent transfer positions is an integral multiple of a driving non-uniformity period of the driving source.

However, in JP-A Sho 63-11967, there arises such a problem that the color misregistration is caused to occur due to transfer speed deviation at the same time correspondingly to a photosensitive member of a driving branch angle of a branch gear for dividing a driving force from the common driving source into components to be transmitted to the plurality of photosensitive drums.

A mechanism of the occurrence of the color misregistration will be described. FIG. 10(*a*) is a schematic sectional view of a drive transmission device and a primary transfer portion of a conventional color image forming apparatus. FIG. 10(*b*) is a schematic view showing rotational speed fluctuation of the branch gear as the common driving source, rotational speed fluctuation of photosensitive drums 1Y and 1M, and each transfer time. In FIG. 10(*b*), a solid line represents speed fluctuation of a photosensitive drum gear 18Y due to the rotational speed fluctuation of a branch gear I, and a broken line represents speed fluctuation of a photosensitive drum gear 18M due to the rotational speed fluctuation of the branch gear 18M.

As shown in FIG. 10(*b*), the photosensitive drums 1Y and 1M are driven by the branch gear I. Further, the branch gear I is driven while meshing with the photosensitive drum gears 18Y and 18M as driven gears, provided at two positions, at a branch angle of θ. Similarly, photosensitive drums 1C and 1K are also driven by the branch gear I similar to that for the photosensitive drums 1Y and 1M. Further, the branch gear I is driven while meshing with photosensitive drum gears 18C and 18K as driven gears, provided at two positions, at a branch angle of θ.

As shown in FIGS. 10(*a*) and 10(*b*), a mesh point between the branch gear I and the photosensitive drum gear 18Y is configured to mesh with the photosensitive drum gear 18M after the mesh point is rotationally moved on a pitch circle of the branch gear I by θ degrees. For that reason, when the rotational speed of the photosensitive drum 1Y is highest at a transfer time TY of the photosensitive drum 1Y, rotational speed fluctuation of the photosensitive drum gear 18M to be meshed with the branch gear I after the rotation by the branch angle of θ degrees is in the largest state. Thus, the rotational speed of the photosensitive drum 1M rotated integrally with the photosensitive drum gear 18M is in the highest state. As a result, the phase is deviated at the same time by a time corresponding not the branch angle θ, so that the rotational speeds of the photosensitive drum 1Y at the transfer time TY and the photosensitive drum 1M at a transfer time TM are different from each other. That is, in a time of movement from a transfer position 19Y to a transfer position 19M (from a transfer position 19C to a transfer position 19K), the difference in rotational speed shown in FIG. 10(*b*) occurs Y Δ to result in a problem that the color misregistration occurs by a distance corresponding to the rotational speed difference of Δ.

SUMMARY OF THE INVENTION

A principal object of the present invention, there is provided an image forming apparatus capable of alleviating color misregistration.

This and other objects, features and advantages of the present invention will become more apparent upon a consideration of the following description of the preferred embodiments of the present invention taken in conjunction with the accompanying drawings.

BRIEF DESCRIPTION OF THE DRAWINGS

FIG. 4(*b*) is a schematic view showing a mesh state in which a radius of rotation of the branch gear I during input of a driving force from the motor gear MG to the branch gear I is smallest. FIG. 4(*c*) is a schematic view showing a mesh state in which the radius of rotation of the branch gear I during the input of the driving force from the motor gear MG to the branch gear I.

FIG. 5(*b*) is a schematic view showing actual rotational speed fluctuation due to the rotational speed fluctuations of the branch gear I.

FIG. 6(*b*) is a schematic view showing actual rotational speed fluctuation of the photosensitive drums 1Y and 1M due to the rotational speed fluctuations of the branch gear I in the case where $\phi=180-\theta/2$(degrees).

FIG. 7(*b*) is a schematic view showing actual rotational speed fluctuation of the photosensitive drums 1Y and 1M due to the rotational speed fluctuations of the branch gear I in the case where $\phi=360-\theta 2$ (degrees).

FIG. 10(*b*) is a schematic view showing rotational speed fluctuation of a common branch gear and each transfer time of photosensitive drums.

DESCRIPTION OF THE PREFERRED EMBODIMENTS

Embodiments of the present invention will be described specifically with reference to the drawings. However, dimensions, materials, shapes, and relative arrangements of constituent elements in the present invention are not limited to those described in the following embodiments since they should be appropriately changed depending on apparatuses to which the present invention is applicable and depending on various conditions.

First Embodiment

An image forming apparatus according to First Embodiment of the present invention will be described with reference to the drawings.

(General Structure of Image Forming Apparatus)

Figure 1:
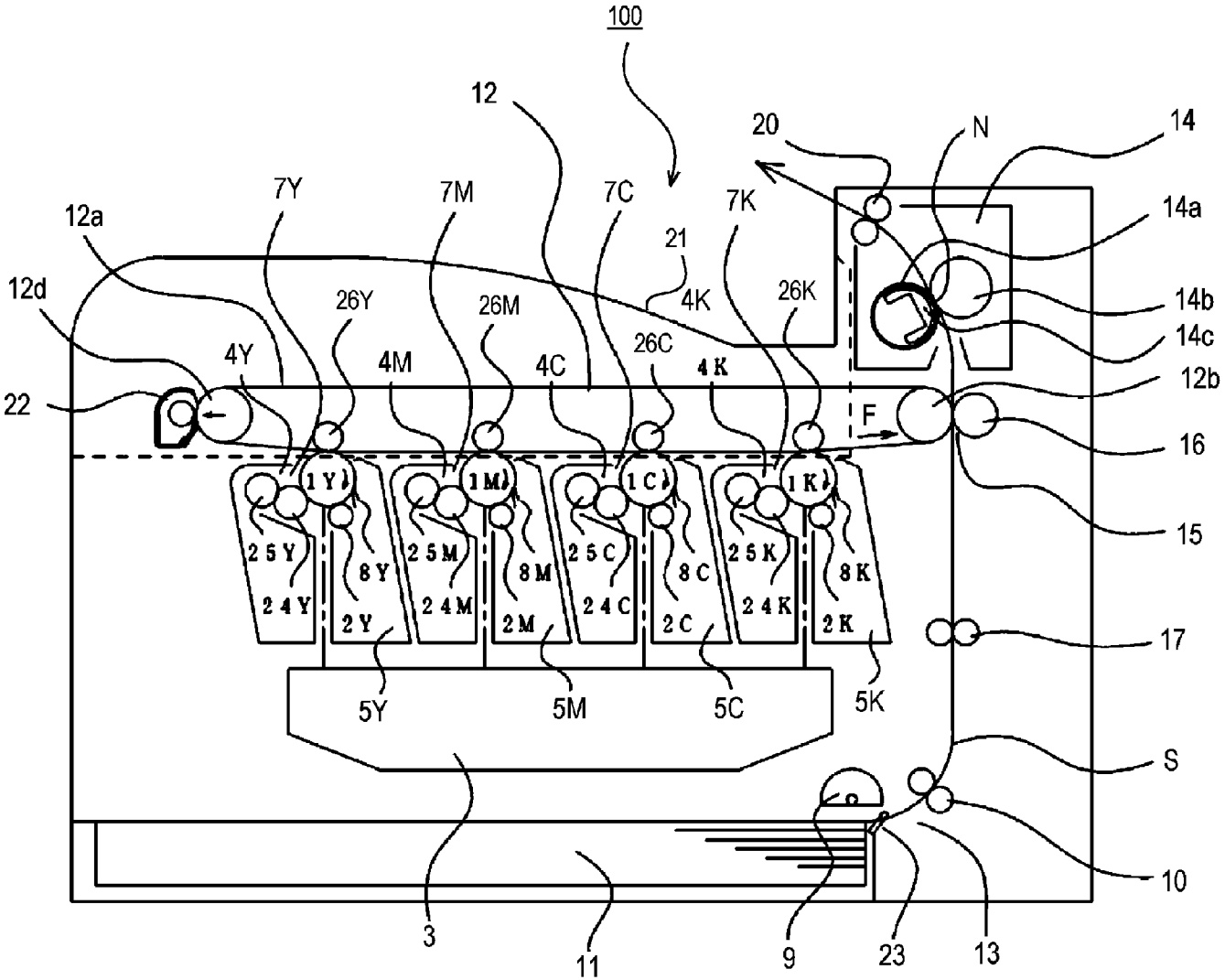
FIG. 1 is an illustration of an image forming apparatus according to First Embodiment.

FIG. 1 is an illustration of the image forming apparatus according to this embodiment. As shown in FIG. 1, a color laser printer 100 as the image forming apparatus includes process cartridges 7 (7Y, 7M, 7C and 7K) as an image forming means, an intermediary transfer belt unit 12, a sheet feeding device 13, and a control portion 101.

The process cartridges 7 form images of toners of yellow (Y), magenta (M), cyan (C) and black (K). Each process cartridge 7 includes a developing unit 4 (4Y, 4M, 4C, 4K) as a developing means and a cleaner unit 5 (5Y, 5M, 5C, 5K). The developing unit 4 includes a developing roller 24 (24Y, 24M, 24C, 24K), a developer application roller 25 (25Y, 25M, 25C, 25K), and a toner container. The cleaner unit 5 includes a photosensitive drum 1 (1Y, 1M, 1C, 1K) as an image bearing member, a charging roller 2 (2Y, 2M, 2C, 2K), a drum cleaning blade 8 (8Y, 8M, 8C, 8K), and a residual toner container.

The photosensitive drum 1 is constituted by applying a layer of an organic photoconductor (OPC) onto an outer peripheral surface of an aluminum cylinder and is rotatably supported by flanges at its both end portions. By transmitting a driving force to one end of the photosensitive drum 1, the photosensitive drum 1 is rotationally driven.

The photosensitive drum 1 charged to a predetermined potential of a negative polarity by the charging roller 2 is irradiated with laser light 30 (30Y, 30M, 30C, 30K) by an exposure means 3, so that an electrostatic latent image is formed. The electrostatic latent image is reversely developed by deposition of the negative-polarity toner thereon by using the developing unit 4, so that toner images of Y, M, C and K are formed on the photosensitive drums 1Y, 1M, 1C and 1K, respectively.

The intermediary transfer belt unit 12 includes an intermediary transfer belt 12*a*, a driving roller 12*b*, and a tension roller 12*d*. The intermediary transfer belt 12*a* is stretched around the driving roller 12*b* and the tension roller 12*d*. Inside the intermediary transfer belt 12*a*, a primary transfer roller 26 (26Y, 26M, 26C, 26K) is disposed oppositely to an associated one of the photosensitive drums 1. The four color toner images formed on the photosensitive drums 1 are successively primary-transferred onto the intermediary transfer belt 12*a* by the primary transfer rollers 26 and are conveyed to a secondary transfer portion 15 in a superposed state.

The sheet feeding device B includes a feeding roller 9, a conveying roller pair 10, and a sheet feeding cassette 11. A sheet S accommodated in the sheet feeding cassette 11 is pressed by the sheet feeding roller 9, separated one by one by a separation pad 23 (friction one-side separation type), and is fed. The sheet S fed by the sheet feeding device 13 is conveyed to the secondary transfer portion by a registration roller pair 17. The sheet S conveyed to the secondary transfer portion 15 is subjected to secondary transfer of the four color toner images from the intermediary transfer belt 12*a* onto the sheet S by a secondary transfer roller 16. The sheet S on which the toner images are transferred is conveyed to a fixing nip N in which the sheet S is subjected to heat and pressure by a fixing portion 14 (including a fixing belt 14*a*, a pressing roller 14*b*, and a belt guide member 14*c*), so that the toner images are fixed. The sheet S on which the toner images are fixed is discharged on a sheet discharge tray 21 by a sheet discharge roller pair 20.

The toner remaining on the surface of the photosensitive drum 1 after the toner image transfer is removed by the cleaning blade 8 and collected in the residual toner container in the cleaner unit 5. Further, the toner remaining on the intermediary transfer belt 12*a* after the secondary transfer on the sheet S is removed by a transfer belt cleaning device 22.

(Drive Transmission Device of Tandem-Type Image Forming Apparatus)

Figure 2:
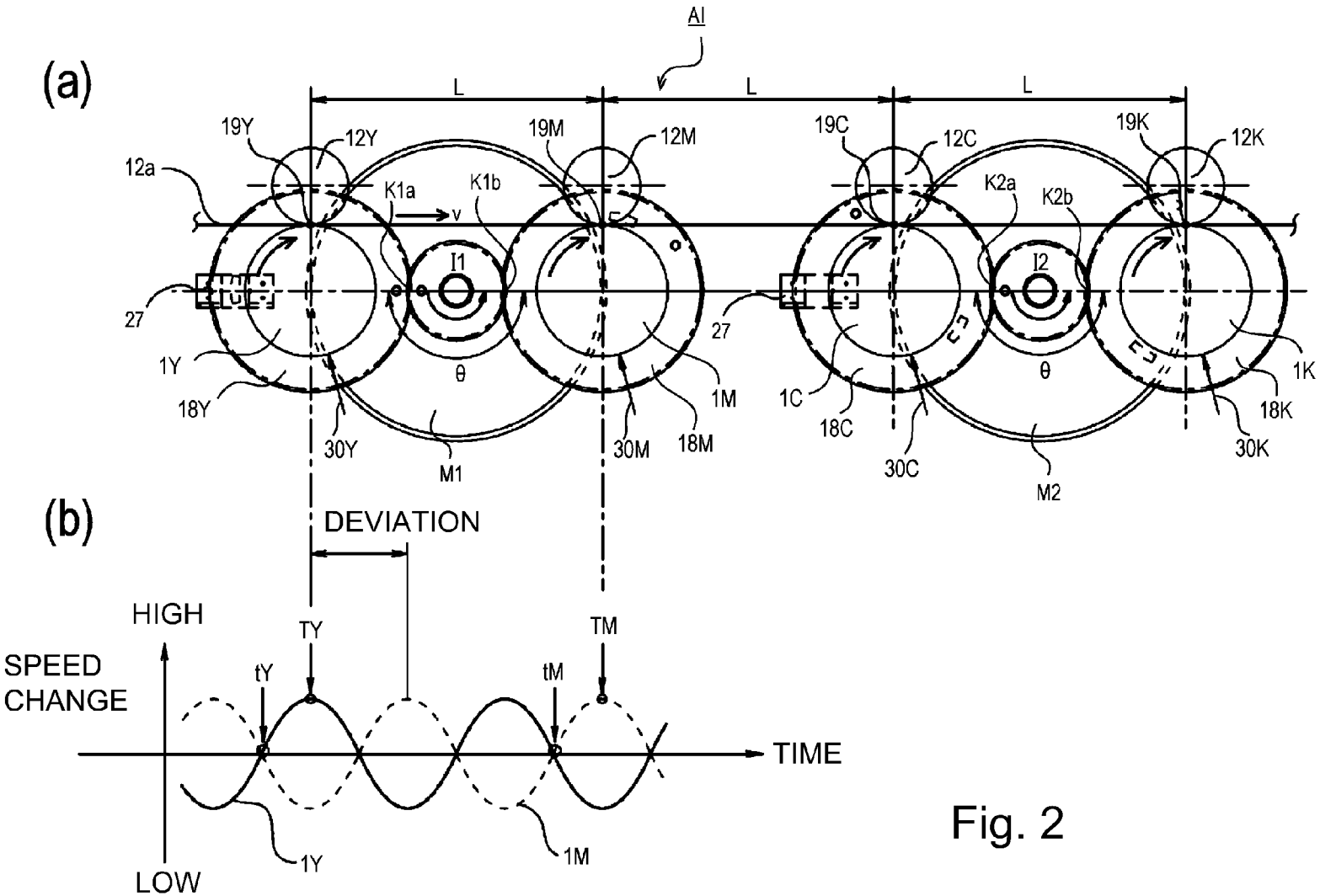
FIG. 2(*a*) is an illustration of a drive transmission device and a primary transfer portion of the image forming apparatus in First Embodiment, and FIG. 2(*b*) is a schematic view showing rotational speed fluctuation of photosensitive drums 1Y and 1M due to rotational speed fluctuation of a branch gear, each transfer time, and each exposure time.

A drive transmission device for the tandem-type color image forming apparatus according to this embodiment will be described. FIG. 2(*a*) is an illustration of the drive transmission device and the primary transfer portion of the image forming apparatus in this embodiment. FIG. 2(*b*) is a schematic view showing rotational speed fluctuation of the photosensitive drums 1Y and 1M due to rotational speed fluctuation of the branch gear, each transfer time, and each exposure time.

As shown in FIG. 2(*a*), a drive transmission device A1 includes a photosensitive drum gear 18 (18Y, 18M, 18C, 18K) and the branch gear I (I1, I2). The gear 18 (18Y, 18M, 18C, 18K) is provided coaxially and integrally with the photosensitive drum 1 (1Y, 1M, 1C, 1K) in order to transmit the driving force to the photosensitive drum 1. The branch gear I (I1, I2) is integrally provided on a rotation shaft of a motor M1 or M2 as a driving source and transmits the driving force to the gear 18. The branch gear I1 drives the driving force into two components transmitted to the gears 18Y and 18M provided at two positions, and the branch gear I2 divides the driving force into two components transmitted to the gears 18C and 18K. A transfer portion (primary transfer position) 19 (19Y, 19M, 19C, 19K) is a press-contact nip, between the intermediary transfer belt 12*a* and the photosensitive drum 1, in which the primary transfer roller 12 (12Y, 12M, 12C, 12K) opposes the photosensitive drum 1 (1Y, 1M, 1C, 1K).

A time of movement of a first mesh point K1*a* (K2*a*) at which the branch gear I and the photosensitive drum gear 18Y (18C) mesh with each other to a second mesh point K1*b* (K2*b*) at which the branch gear I and the photosensitive drum gear 18M (18K) mesh with each other through rotational movement on a pitch circle of the branch gear I is T1. A time of integer-time rotation of the branch gear I is T2. A time of movement of the intermediary transfer belt 12*a* (transfer material) from the transfer position of the photosensitive drum gear 18Y (18C) to the transfer position of the photosensitive drum gear 18M (18K) is T2. A control portion 101 controls the gear 18Y (18C), the gear 18M (18K), the branch gear I, and the movement time of the intermediary transfer belt 12*a* so that the sum of T1 and T2 is equal to T3.

Here, the rotation of the photosensitive drum 1 and the rotation of a gear train (the branch gear I and the gear 18) will be described. Each of a distance between the transfer positions 19Y and 19M, a distance between the transfer positions 19< and 19C, and a distance between the transfer positions 19C and 19K is set at L (mm). The photosensitive drum 1 and the intermediary transfer belt 12*a* are rotated at the same peripheral speed V (mm/sec). The two branch gears I1 and I2 have the same shape and are rotated at a speed with the same period G (sec). The branch gear I1 and I2 have the same shape as described above, thus being rotated in the same period and the same eccentric amount. Incidentally, the gears 18Y, 18M, 18C and 18K also have the same shape.

The adjacent gears 18Y and 18M to which the driving force is to be transmitted by the branch gear I1 are branches spaced by the branch gear I1 and mesh with the branch gear I1 at an angle θ (degrees). This angle θ is referred to as a branch angle θ. The gears 18C and 18K to which the driving force is to be transmitted by the branch gear I2 are similarly configured to mesh with the branch gear I2 at the angle θ (degrees). With respect to the branch angle θ (degrees), a sign of the angle is positive (+) for rotation of the branch gear I1 in a direction from the first mesh point K1*a* (K2*a*) at which the branch gear I1 meshes with the upstream gear 18Y (18C) to the second mesh point K1*b* (K2*b*) at which the branch gear I1 meshes with the downstream gear 18M (18K) (in a counterclockwise rotational direction of the branch gear I1 in FIG. 2(*a*)).

A time of movement of the intermediary transfer belt 12*a* between the transfer positions 19Y and 19M, i.e., a transfer interval between the photosensitive drums 1Y and 1M, for two colors, to which the driving force is transmitted from the branch gear I1 is T3. A time of n-time rotation of the branch gear I1 is T2. A time of movement of a portion of the branch gear I1 located at the first mesh point K1*a* to the second mesh point K1*b* through rotational movement on the pitch circle is T1. These times are set so that the sum of T1 and T2 equal to T3.

Similarly, a time of movement of the intermediary transfer belt 12*a* between the transfer positions 19C and 19K, i.e., a transfer interval between the photosensitive drums 1C and 1K for two colors to which the driving force is transmitted from the branch gear I2 is T3. A time of n-time rotation of the branch gear I2 is T2. A time of movement of a portion of the branch gear I2 located at the first mesh point K2*a* to the second mesh point K2*b* through rotational movement on the pitch circle is T1. These times are set so that the sum of T1 and T2 equal to T3.

That is, the distance L between adjacent transfer positions, the peripheral speed v of the intermediary transfer belt 12*a*, and the period G of the branch gear I (I1, I2) are configured to satisfy the following relationship:

$$L/v=\{n+(\theta/360)\}\times G(n\text{:integer}) \quad (1.1).$$

Description will be further made with reference to FIGS. 2(*a*) and 2(*b*). In these figures, the distance L=53.4 mm, the peripheral speed v=99.7 1 mm/sec, the branch angle θ=180° (degrees) are set. In FIG. 2(*b*), an ordinate represents the rotational speed fluctuation ("DRUM SPEED") of the photosensitive drums 1Y and 1M due to eccentricity or the like of the rotation shaft of the branch gear I1. In FIG. 2(*b*), an abscissa represents the transfer times TY and TM and the exposure times tY and tM with respect to the photosensitive drums 1Y and 1M. Here, the transfer times TY and TM and the exposure times tY and tM are examples thereof in the case where the respective color toner images are transferred onto the same position of the intermediary transfer belt 12*a*. In FIG. 2(*b*), a solid line represents the rotational speed fluctuation of the photosensitive drum 1Y and a broken line represents the rotational speed fluctuation of the photosensitive drum 1M.

As shown in FIG. 2(*b*), at the transfer time TY, the rotational speed of the photosensitive drum 1Y rotated by the branch gear I1 is highest (fastest). On the other hand, at the same time (transfer time TY), the photosensitive drum 1M is phase shifted by the branch angle θ (180° in this constitution) with respect to the photosensitive drum 1Y, so that the rotational speed of the photosensitive drum 1M is lowest (slowest). Therefore, at the transfer time TM at which the image transferred on the intermediary transfer belt 12*a* at the transfer position 19Y has been moved to the transfer position 19M (after lapse of L/v=53.4/99.71=0.536 sec from the transfer time TY), the rotational speed of the photosensitive drum 1M is equal to the rotational speed of the photosensitive drum 1Y. Thus, the rotational speeds of the respective photosensitive drums during the transfer are equal to each other, so that the color misregistration between the two colors occurring during the transfer can be suppressed.

Also during the exposure, similarly as during the transfer, the color misregistration between the two colors occurring during the exposure can be suppressed. Specifically, an angle from the exposure position, in which the exposure to the laser light 30Y is effected, to the transfer position 19Y and an angle from the exposure position, in which the exposure to the laser light 30M is effected, to the transfer position 19M are set at the same value. That is, a time of rotation of the photosensitive drum 1Y from the exposure position (of the photosensitive drum 1Y) to the transfer position (of the photosensitive drum 1Y) and a time of rotation of the photosensitive drum 1M from the exposure position (of the photosensitive drum 1M) and the transfer position (of the photosensitive drum 1M) are equal to each other. For this reason, as shown in FIG. 2(*b*), the rotational speed of the gear 18 at the exposure time tY of the photosensitive drum 1Y is equal to the rotational speed of the gear 18 at the exposure time tM (after lapse of L/v=0.536 sec from the transfer time TY). As a result, the rotational speeds of the respective photosensitive drums 1 during the exposure are equal to each other, so that the color misregistration between the two colors occurring during the exposure can be suppressed.

Further, the gears 18C and 18K and the branch gear I2 have the same shape and arrangement as those of the gears 18Y and 18M and the branch gear I1. Therefore, similarly as in the case of the branch gear I1 and the gears 18Y and 18M, the branch gear I2 and the gears 18C and 18K are also configured to be in phase with each other so that they have the same phase at a time from passing of the intermediary transfer belt 12*a* through the transfer position 19C to reaching to the transfer position 19K.

To the gears 18Y and 18C, gear phase detection sensors 27 are provided, respectively. The two gear phase detection sensors 27 detect the phases of the gears 18Y and 18C by sensor flags (not shown) provided integrally with the gears 18Y and 18C. Based on this detection result, two motors M1 and M2 are controlled to effect phase alignment of the gears 18Y and 18C. As a result, the two branch gears I1 and I2 are in phase with each other at a time from passing of the intermediary transfer belt 12*a* through the transfer position 19Y to reaching to the transfer position 19C.

In this way, the gears 18Y and 18C can be made in phase with each other at the transfer positions 19Y and 19C. As a result, the form gears 18Y, 18M, 18C and 18K can be in phase with each other at the respective transfer positions 19Y, 19M, 19C and 19K, so that the color misregistration among the four colors occurring during the transfer can be suppressed. Further, similarly as in the color misregistration during the transfer, the rotational speed fluctuations of the four gears 18Y, 18M, 18C and 18K during the respective exposures can be made in phase with each other, so that the color misregistration among the four colors occurring during the exposure can be suppressed.

Hereinafter, the description will be made more specifically based on specific numerical values. In FIGS. 2(*a*) and 2(*b*), a rotational frequency ω of the motor M1 and M2 is set at 168.027 (rpm), and the number of tooth of the branch gear I1 and I2 is set at 34. The period G (sec) of the branch gear I1 and I2 is set at G=1/(ω/60) (sec). Therefore, the period G of the branch gears I1 and I2 can be obtained from the rotational frequency of the motors M1 and M2 as follows:

$$G=1/(\omega/60)=1/(168.027/60)=0.357(\text{sec}).$$

The branch angle θ is 180° and therefore in (integer) can be obtained as follows:

$$L/v=\{n+(180/360)\}\times 0.357$$

$$n=\{(L/v)/0.357\}-½=\{(53.4/99.71)/1.0357\}-1.2\approx 1.000148\approx 1.0.$$

That is, each of the branch gears I1 and I2 is set so as to rotate one turn and the branch angle of 180° at the time of movement at the distance L between the transfer positions.

Incidentally, in this embodiment, the constitution using the intermediary transfer belt 12*a* is described but the present invention is not limited thereto. For example, in place of the intermediary transfer belt 12*a*, it is also possible to employ a constitution in which an electrostatic attraction belt for attracting and conveying the sheet S as a recording material and directly transferring the toner images onto the sheet S.

In this embodiment, the color misregistration with respect to the drive transmission device of the image forming apparatus is described but there are other generating factors of the color misregistration. For example, the generating factors include accuracy with respect to mounting positions such as the positions of the photosensitive drums for the four colors, the positions of the exposure means, and the positions of the transfer means; and accuracy with respect to dimensions such as an outer diameter error or eccentricity of the driving roller, film thickness accuracy of the transfer belt, and an outer diameter error or eccentricity of the photosensitive drum.

For that reason, it is difficult to obtain a high-image quality image forming apparatus unless the color misregistration with respect to the drive transmission device is suppressed to a level of about ½ dot at the maximum, i.e., about 20 μm or less in terms of an image resolution of 600 dpi. In this embodiment, as described above, theoretical color misregistration with respect to the drive transmission device is reduced as small as possible by satisfying the relationship of:

$$L/v=\{n+(\theta/360)\}\times G(n:\text{integer}).$$

That is, even when the branch angle θ is not 180°, an effect of alleviating the color misregistration is enhanced with a value of the branch angle θ closer to 180°. In this embodiment, it has been theoretically configured that the maximum color misregistration among the four colors is 20 μm or less when the branch angle θ (degrees) is within ±24°. For this reason, the effect of the present invention is achieved when the branch angle θ (degrees) is in the range of 156° to 204° with respect to its optimum value of 180°. Similarly, even when the above-described relationship is not established to some extent, the color misregistration with respect to the drive transmission device may only be required to be about 20 μm or less.

Second Embodiment

Figure 3:
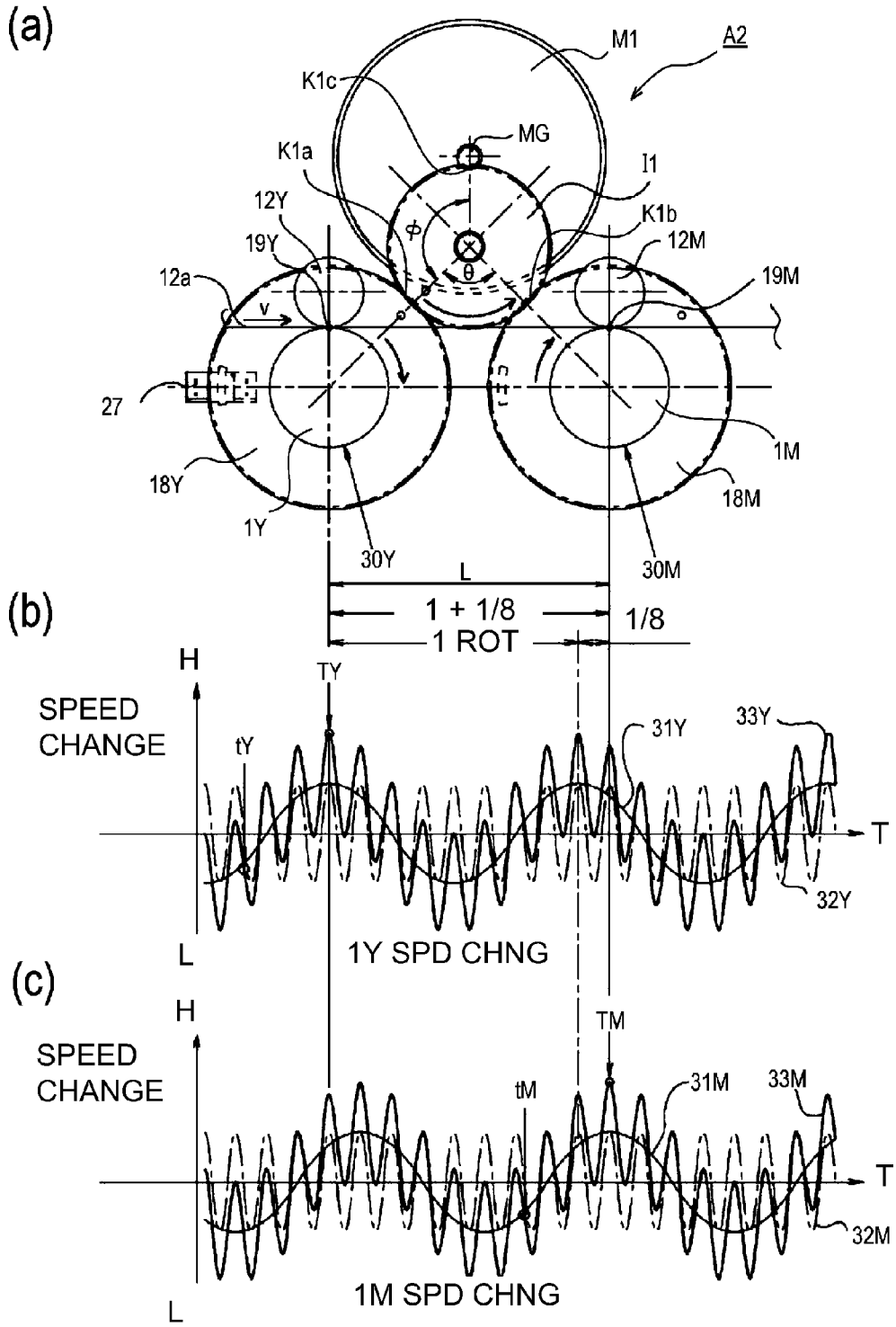
FIG. 3(*a*) is an illustration of a drive transmission device and a primary transfer portion of an image forming apparatus according to Second Embodiment, FIG. 3(*b*) is a schematic view showing rotational speed fluctuation of a photosensitive drum 1Y due to rotational speed fluctuation of a branch gear I and a motor gear MG, each transfer time (TY, TM), and each exposure time (tY, tM), and FIG. 3(*c*) is a schematic view showing rotational speed fluctuation of a photosensitive drum 1M due to rotational speed fluctuation of the branch gear I and the motor gear MG, each transfer time (TM, TY) and each exposure time (tM, tY).

Next, Second Embodiment of the image forming apparatus according to the present invention will be described with reference to the drawings. Portions identical to those in First Embodiment will be omitted from redundant description by adding the same reference numerals or symbols. FIG. 3(*a*) is an illustration of the drive transmission device and the primary transfer portion of the image forming apparatus in this embodiment. A difference of this embodiment from First Embodiment is that the branch gear I in the drive transmission device is the motor gear integrally mounted on the rotation shaft of the motor in First Embodiment but is an idler gear. Incidentally, the branch gear I2 and the gears 18C and 18K have the same constitution as the branch gear I1 and the gears 18Y and 18M, thus being omitted from explanation.

The gears 18Y and 18M are disposed adjacent to each other and to which the driving force is transmitted from the branch gear I1. The motor gear MG is integrally mounted on the rotation shaft of the motor M1 as the driving source and corresponds to an upstream gear for transmitting the driving force to the branch gear I1. The distances between the transfer positions 19Y and 19M, between the transfer positions 19M and 19C, and between the transfer positions 19C and 19K are set at L (mm). The intermediary transfer belt 12*a* is rotated at the peripheral speed v (mm/sec) and the photosensitive drum 1 (1Y, 1M, 1C, 1K) is rotated at a peripheral speed equal to the peripheral speed v of the intermediary transfer belt 12*a*.

The branch gear I1 is rotated at the speed with the period G (sec) and the motor gear MG is rotated at the speed with a period Ga (sec). The gears 18Y and 18M (the gears 18C and 18K) mesh with the branch gear I1 so as to form branches spaced by the branch gear I1 at the branch angle θ (degrees). With respect to the branch angle θ (degrees), a sign of the angle is positive (+) for rotation of the branch gear I1 in a direction from the first mesh point K1*a* (K2*a*) at which the branch gear I1 meshes with the upstream gear 18Y (18C) to the second mesh point K1*b* (K2*b*) at which the branch gear I1 meshes with the downstream gear 18M (18K) (in the counterclockwise rotational direction of the branch gear I1 in FIG. 3(*a*)).

An angle ϕ (degrees) of rotation of the branch gear I1 in order that a portion of the branch gear I1 located at a third mesh point K1*c* at which the motor gear MG and the branch gear I1 mesh with each other is moved to the first mesh point K1*a* at which the branch gear I1 and the gear 18Y mesh with each other, is referred to as a mesh angle ϕ (degrees). With respect to the mesh angle ϕ (degrees), a sign of the angle is positive (+) for rotation of the branch gear I1 in a direction from the upstream mesh point K1*c* to the downstream mesh point K1*a* (in the counterclockwise rotational direction of the branch gear I1 in FIG. 3(*a*)).

Before specific description of this embodiment, first, a mechanism of the rotational speed fluctuation of the branch gear and an influence of the rotational speed fluctuation on the color misregistration will be described.

<Rotational Speed Fluctuation of Branch Gear>

Figure 4:
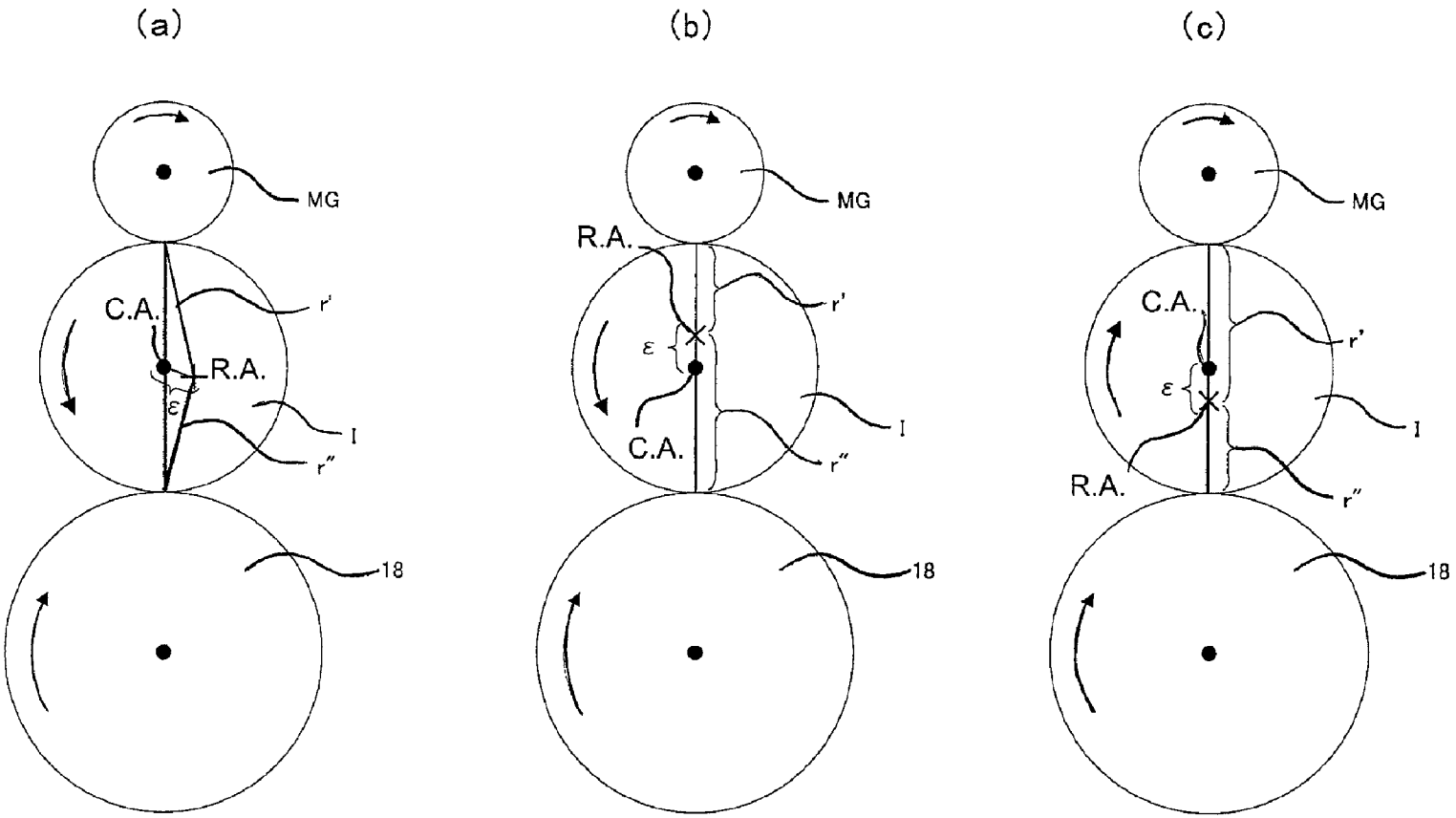
FIG. 4(*a*) is a schematic view showing a mesh state among the motor gear MG, a photosensitive drum gear 18, and the branch gear I in which a rotational axis is eccentric by an eccentric amount ϵ from a gear center (center axis).

FIGS. 4(*a*), 4(*b*) and 4(*c*) show a mesh state among the motor gear MG, the photosensitive drum gear 18, and the branch gear I for which the rotational axis is eccentric in an eccentric amount ϵ with respect to the gear center (center axis). With respect to the branch gear I1, the motor gear MG is located on an upstream side of a driving force transmitting direction and the photosensitive drum gear 18 is located on a downstream side of the driving force transmitting direction. In FIGS. 4(*a*), 4(*b*) and 4(*c*), for easy explanation, the mesh angle ϕ is simply illustrated as 180°. A circle of each of the gears is illustrated on the basis of a pitch circle radius. The pitch circle radius of the branch gear I is r, a distance from the rotational axis of the branch gear I to the mesh point with respect to the motor gear MG is r', and a distance from the rotational axis of the branch gear I to the mesh point with respect to the photosensitive drum gear 18 is r". FIG. 4(*b*) shows the mesh state in which the value r' as the radius of rotation during input of the driving force from the motor gear MG into the branch gear I is smallest (r−ϵ). In this eccentric state, the value r" as the radius of rotation during output of the driving force from the branch gear I to the photosensitive drum gear 18 is largest (r+ϵ). Similarly, FIG. 4(*c*) shows the mesh state in which the radius r' of rotation during the input is largest (r+ϵ) and the radius r" of rotation during the output is smallest (r−ϵ).

The state of FIG. 4(*b*) will be described. First, the mesh between the branch gear I and the motor gear MG will be described. In the case where the radius of rotation of the branch gear I is smaller than that when the branch gear I is rotated about the gear center (center axis), with respect to the rotation of the motor gear MG located on the upstream side of the driving force transmitting direction, the branch gear I is rotated in a larger number than that when the branch gear I is rotated about the gear center. That is, when the value r' of the radius of rotation during the input is smallest (r−ϵ) as shown in FIG. 4(*b*), with respect to the rotation of the motor gear MG, the rotational speed of the branch gear I is largest.

Next, the mesh between the branch gear I and the photosensitive drum gear 18 will be described. In the case where the radius of rotation of the branch gear I is larger than that when the branch gear I is rotated about the gear center the rotation of the photosensitive drum gear 18 located on the downstream side of the driving force transmitting direction is rotated, with respect to the rotation of the branch gear I, in a larger number than that when the branch gear I is rotated about the gear center. That is, when the value r" of the radius of rotation during the output is largest (r+ϵ) as shown in FIG. 4(*b*), the photosensitive drum gear 18 is rotated at the highest speed and therefore, the rotational speed of the photosensitive drum gear 18 is largest.

Next, the mesh between the branch gear I and the photosensitive drum gear 18 will be described. In the case where the radius of rotation of the branch gear I is larger than that when the branch gear I is rotated about the gear center, the rotation of the photosensitive drum gear 18 located on the downstream side of the driving force transmitting direction is rotated, with respect to the rotation of the branch gear I, in a larger number than that when the branch gear I is rotated about the gear center. That is, when the value r" of the radius of rotation during the output is largest (r+ϵ) as shown in FIG. 4(*b*), the photosensitive drum gear 18 is rotated at the highest speed and therefore the rotational speed of the photosensitive drum gear 18 is largest. In other words, the state of FIG. 4(*b*) is such a state that the rotational speed of the branch gear I during the input is largest and the rotational speed of the photosensitive drum gear 18 meshing with the branch gear I during the output is also largest. That is, in the state of FIG. 4(*b*), the photosensitive drum gear 18 is in a state in which the rotational speed thereof is highest.

Next, the state of FIG. 4(*c*) will be described. First, the mesh between the branch gear I and the motor gear MG will be described. In the case where the radius of rotation of the branch gear I is larger than that when the branch gear I is rotated about the gear center, with respect to the rotation of the motor gear MG located on the upstream side of the driving force transmitting direction, the branch gear I is rotated in a smaller number than that when the branch gear I is rotated about the gear center. That is, when the value r' of the radius of rotation during the input is largest (r+ϵ) as shown in FIG. 4(*c*), with respect to the rotation of the motor gear MG, the rotational speed of the branch gear I is largest.

Next, the mesh between the branch gear I and the photosensitive drum gear 18 shown in FIG. 4(*c*) will be described. In the case where the radius of rotation of the branch gear I is smaller than that when the branch gear I is rotated about the gear center, the rotation of the photosensitive drum gear 18 is rotated, with respect to the rotation of the branch gear I, in a smaller number than that when the branch gear I is rotated about the gear center. That is, when the value r" of the radius of rotation during the output is smallest (r−ϵ) as shown in FIG. 4(*c*), the photosensitive drum gear 18 is rotated at the lowest speed and therefore the rotational speed of the photosensitive drum gear 18 is smallest. In other words, the state of FIG. 4(*c*) is such a state that the rotational speed of the branch gear I during the input is smallest and the rotational speed of the photosensitive drum gear 18 meshing with the branch gear I during the output is also smallest.

The above-described relationship between the rotational speed of the photosensitive drum gear 18 and the radius of rotation of the branch gear I during the input of the driving force into the branch gear I (during the mesh between the branch gear I and the motor gear MG) and the relationship between the rotational speed of the photosensitive drum gear 18 and the radius of rotation of the branch gear I during the output of the driving force from the branch gear I (during the mesh between the branch gear I and the photosensitive drum gear 18) are summarized in Table 1.

TABLE 1

| Driving force transmission | Radius of rotation small | Radius of rotation large |
|---|---|---|
| Upstream (Input) | fast rotation | slow rotation |
| Downstream (Output) | slow rotation | fast rotation |

That is, when the radius of rotation of the branch gear 2 during the input, the rotational speed of the branch gear I is fast, with the result the rotational speed of the photosensitive drum gear 18 is fast as shown in Table 1. When the radius of rotation of the branch gear I is small during the output, the rotational speed of the branch gear I is slow, with the result that the rotational speed of the photosensitive drum gear 18 is slow. The rotational speed of the photosensitive drum gear 18 is slow when the radius of rotation of the branch gear I is large during the input and is fast when the radius of rotation of the branch gear I is large during the output. Thus, the relationship between the radius of rotation of the branch gear I and the rotational speed of the photosensitive drum gear 18 is reverse between the upstream side (during the input) and the downstream side (during the output) with respect to the driving force transmitting direction.

Based on such a relationship, methods of aligning the mesh angles and the gear phases will be described below.

In order to alleviate the color misregistration occurring during the transfer by the branch gear I, a first condition is that rotational speed fluctuation amplitudes for the two colors are made coincide with each other, and a second condition is that rotational speed fluctuation phases for the two colors are made coincide with each other.

<Design Condition 1>

Figure 5:
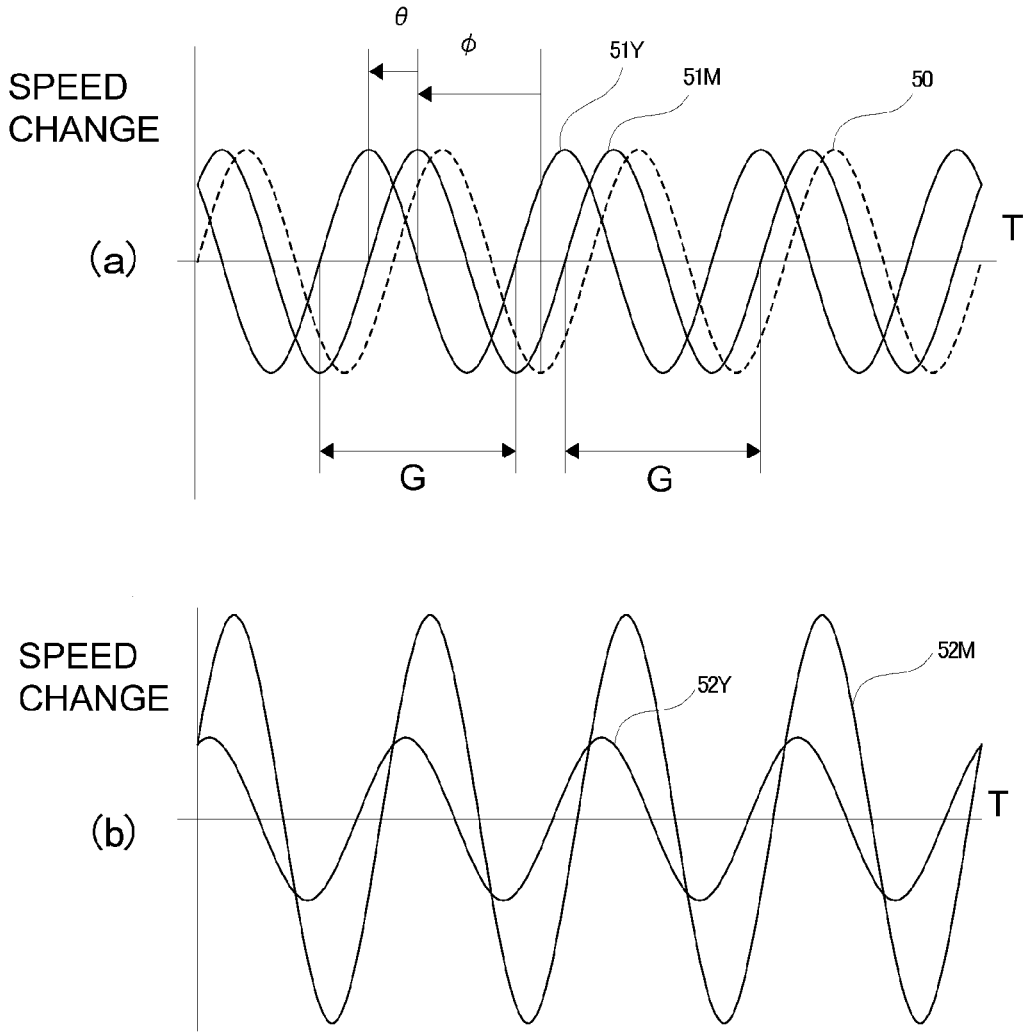
FIG. 5(*a*) is a schematic view showing rotational speed fluctuation of the photosensitive drums 1Y and 1M due to rotational speed fluctuation of the branch gear I during the input and rotational speed fluctuation of the branch gear I during output.

First, as the first condition for alleviating the color misregistration occurring during the transfer, a method of making the rotational speed fluctuation amplitudes for the two colors coincide with each other will be described. FIGS. 5(*a*) and 5(*b*) and FIGS. 7(*a*) and 7(*b*) show speed fluctuation (ΔV) of the photosensitive drums 1Y(1C) and 1M(1K) due to the rotational speed fluctuation of the branch gear (I1, I2). A speed fluctuation 50 during the input of the driving force into the branch gear I (during the mesh between the branch gear I and the motor gear MG) is identical in behavior irrespective of the colors of Y and M. The speed fluctuation of the photosensitive drum 1Y during the output of the driving force from the branch gear I is 51Y and the speed fluctuation of the photosensitive drum 1M during the output of the driving force from the branch gear I is 51M. The speed fluctuation 51M of the photosensitive drum 1M is phase shifted from the speed fluctuation 51Y of the photosensitive drum 1Y by the branch angle θ. Both of the photosensitive drums 1Y and 1M are fluctuated in speed by the same branch gear I, so that the amplitudes of the speed fluctuations 50, 51Y and 51M are equal to each other. The relationship between the speed fluctuation 50 during the input of the driving force into the branch gear I and the speed fluctuation 51Y during the output of the driving force from the branch gear I corresponds to the phase deviation by the mesh angle ϕ. Here, as described with reference to FIGS. 4(*b*) and 4(*c*) and Table 1, the relationship between the radius of rotation of the branch gear I and the speed fluctuation of the photosensitive drum gear 18 is reverse between the driving force transmitting direction upstream side (during the input) and the driving force transmitting direction downstream side (during the output). For this reason, the relationship between the speed fluctuation 50 during the driving force input into the branch gear I and the speed fluctuation 51Y during the driving force output from the branch gear I corresponds to the phase deviation by the mesh angle ϕ and is such that the amplitudes thereof are inverted.

Figure 6:
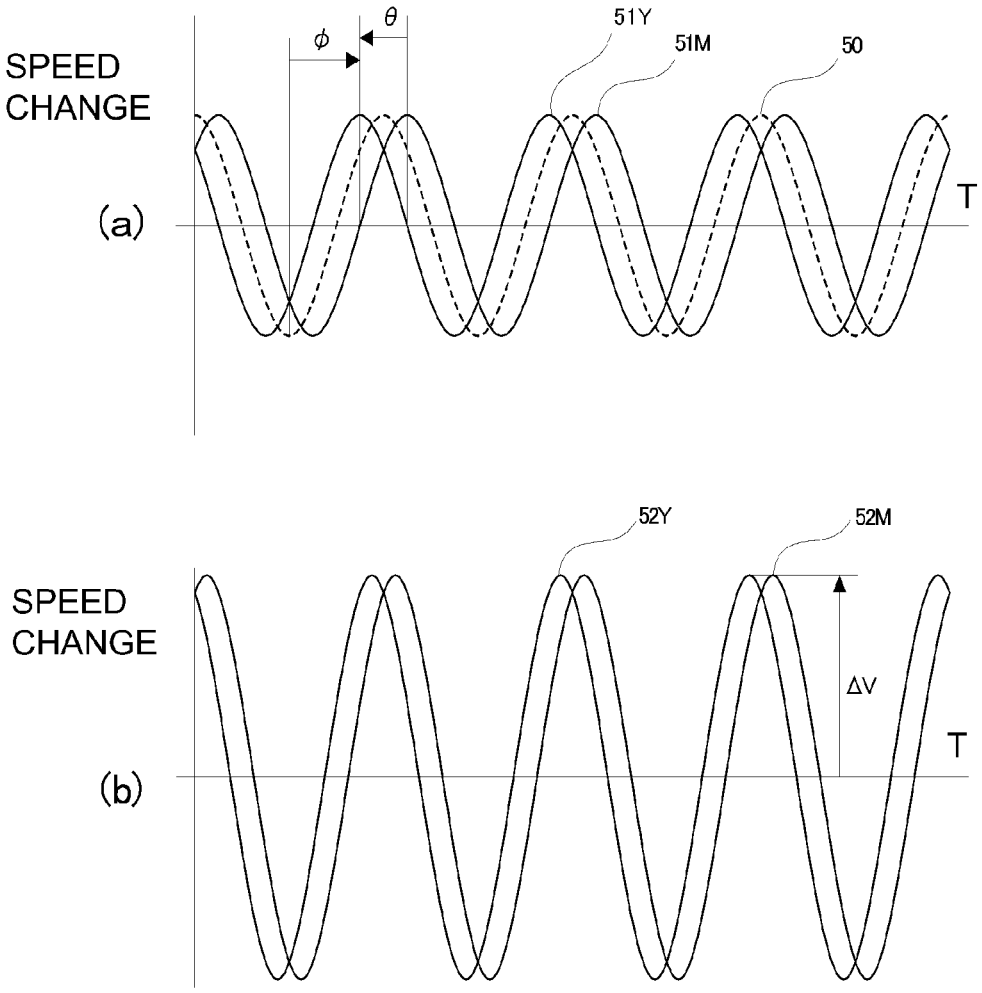
FIG. 6(*a*) is a schematic view showing rotational speed fluctuation of the photosensitive drums 1Y and 1M due to the rotational speed fluctuation of the branch gear I during the input and the rotational speed fluctuation of the branch gear I during the output in the case where $\phi=180-\theta/2$ (degrees) is set.

An actual speed fluctuation of the photosensitive drum 1Y by the branch gear I is, as shown in FIGS. 5(*b*) and 6(*b*), represented by 52Y which is superposition of the component 50 during the input with the component 51Y during the output. Similarly, an actual speed fluctuation of the photosensitive drum 1M by the branch gear I is represented by 52M which is superposition of the component 50 during the input with the component 51M during the output. FIGS. 5(*a*) and 5(*b*) show the case where the mesh angle ϕ is set irrespective of the branch angle θ. In FIG. 5(*b*), the amplitudes of 52Y and 52M do not coincide with each other. FIGS. 6(*a*) and 6(*b*) show the case where the mesh angle ϕ is set to satisfy: ϕ=180−θ/2(degrees). In FIG. 6(*b*), it is understood that the amplitudes of 52Y and 52M coincide with each other. This means that the speed fluctuation common to the two colors of Y and M is phase shifted to an intermediate position between the behaviors (fluctuation curves) of 51Y and 51M. As a result, the behavior of 50 deviated from 51Y and 51M provides a symmetric system, so that the behavior of 52Y=50+51Y and the behavior of 52M=50+51M coincide with each other.

Figure 7:
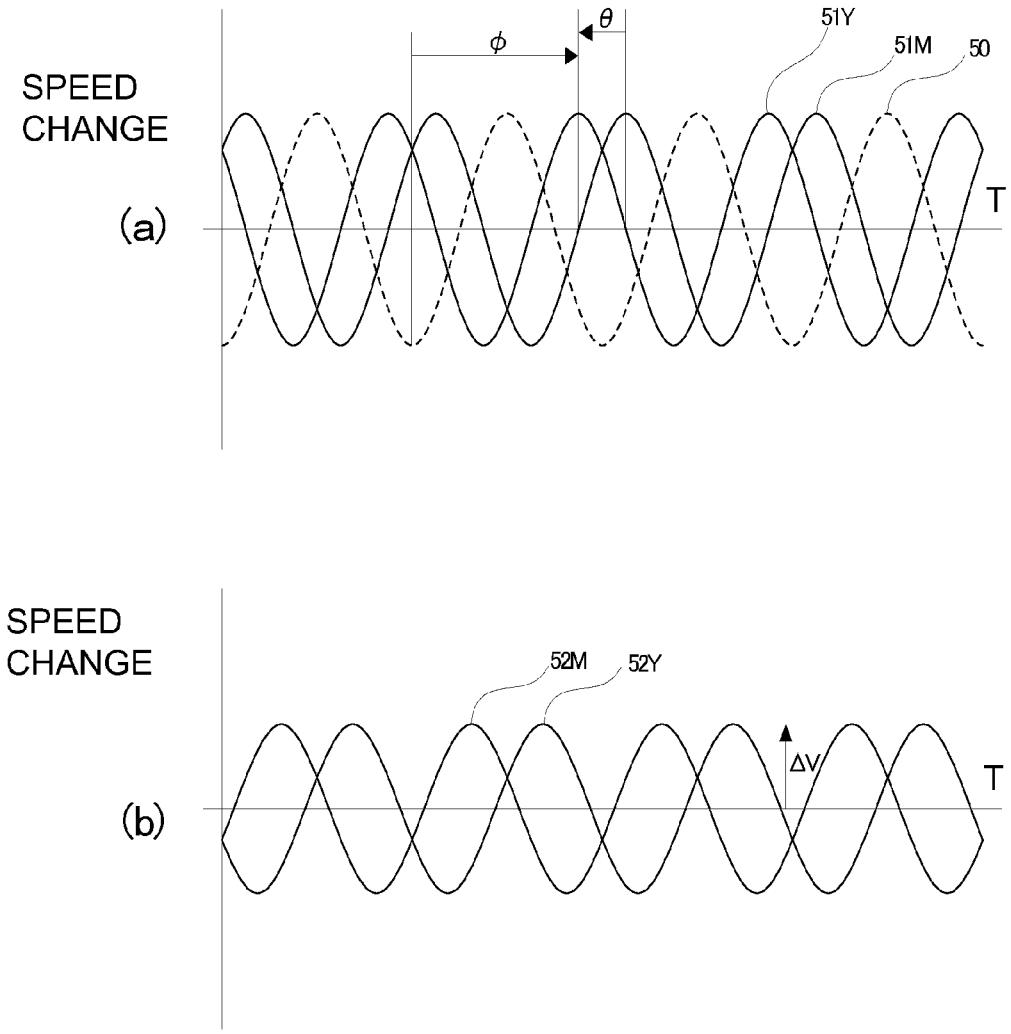
FIG. 7(*a*) is a schematic view showing rotational speed fluctuation of the photosensitive drums 1Y and 1M due to the rotational speed fluctuation of the branch gear I during the input and the rotational speed fluctuation of the branch gear I during the output in the case where $\phi=360-\theta 2$ (degrees) is set.

FIGS. 7(*a*) and 7(*b*) show the case where the mesh angle ϕ is set to satisfy: ϕ=360−θ/2 (degrees) as the other solution for providing the symmetric system. In FIG. 7(*b*), it is understood that the amplitudes of 52Y and 52M coincide with each other.

As described above, it is found that the method of making the amplitudes of the speed fluctuations (52Y, 52M) between the two colors coincide with each other may be realized by appropriately setting the mesh angle ϕ and that there are two solutions for the method. Therefore, the setting method of the mesh angle ϕ is generalized as follows:

$$\phi=180-\theta/2 \quad (2.1), \text{ or}$$

$$\phi=360-\theta/2 \quad (2.2).$$

<Design Condition 2>

The method of making the amplitudes of the speed fluctuations (52Y, 52M) between the two colors coincide with each other as described above with reference to FIGS. 6(*a*), 6(*b*), 7(*a*) and 7(*b*) and the formulas (2.1) and (2.2). However, as shown in FIGS. 6(*a*), 6(*b*), 7(*a*) and 7(*b*), the phases of the speed fluctuations between the two colors do not coincide with each other, so that it is understood that it is difficult to alleviate the color misregistration only by appropriately setting the mesh angle ϕ.

Next, as the second condition for alleviating the color misregistration occurring during the transfer by the branch gear I, the method of making the phases of the speed fluctuations between the two colors coincide with each other by the distance L (mm) between adjacent transfer positions will be described.

In this embodiment, the case where the mesh angle ϕ satisfies the formula (2.1), i.e., ϕ=180−θ/2 showing the state of FIGS. 6(*a*) and 6(*b*) will be described. The speed fluctuation 51M is phase delayed for the branch angle θ with respect to the speed fluctuation 51Y. Further, the speed fluctuation 50 during the input is located at the intermediate position the speed fluctuations 51Y and 51M, so that both of the phase difference between the speed fluctuations 51Y and 50 and the phase difference between the speed fluctuations 50 and 51M are θ/2. Therefore, the phase difference between the component 51Y during the output and the component 52Y obtained by superposing the component 50 during the input and the component 51Y during the output is θ/4. Similarly, the phase difference between the component 51M during the output and the component 52M obtained by superposing the component 50 during the input and the component 51M during the output is θ/4. Therefore, it is understood that the phase difference between the speed fluctuations 52Y and 52M for the two colors is: θ−(θ/4+θ/4)=θ/2. For this reason, when the mesh angle ϕ satisfies: θ=180−θ/2, the branch gear I is configured to perform integer-time rotation (turn) and θ/2 rotation (turn) at the time of movement of the intermediary transfer belt 12*a* at the distance L (mm) between the transfer positions for the two colors of Y and M. When the setting is effected in this way, the rotational speeds of the photosensitive drums 1Y and 1M during the transfer can be made equal to each other, so that the color misregistration between the two colors of Y and M can be alleviated.

That is, when the distance L between adjacent transfer positions, the peripheral speed v of the intermediary transfer belt 12*a* and the period G of the branch gear I satisfy both of the following formulas (2.1) and (2.3):

$$\phi=180-\theta/2 \quad (2.1),\text{and}$$

$$L/v=\{n+(\theta/2)/360\}\times G \quad (2.3),$$

in which n is an integer of 0 or more (0, 1, 2, . . . ), it is possible to alleviate the color misregistration between the two colors of Y and M. Incidentally, also during the exposure, the color misregistration between the two colors occurring during the exposure can be alleviated when the time L/v at which the intermediary transfer belt 12*a* moves the distance L between the transfer positions for the two colors of Y and M is replaced, in the formula (2.3), with an interval Sa between exposure times for the two colors (Y, M).

Next, the description will be made based on specific numerical values. FIG. 3(*b*) is a schematic view showing the rotational speed fluctuation of the photosensitive drum 1Y due to the rotational speed fluctuations of the branch gear I and the motor gear MG, and each transfer time (TY, TM) and each exposure time (tY, tM) in image formation performed in association with the two colors. FIG. 3(*c*) is a schematic view showing the rotational speed fluctuation of the photosensitive drum 1M due to the rotational speed fluctuations of the branch gear I and the motor gear MG, and each transfer time (TM, TY) and each exposure time (tM, tY) in the image formation.

A time of movement of the intermediary transfer belt 12*a* at the interval between the transfer positions 19Y and 19M, for the two colors, to which the divided driving forces are transmitted from the branch gear I1 is S (=L/v) (sec). The period of the branch gear I1 is G (sec), and the period of the motor gear MG is Ga (sec). In this case, the parameters S, G, Ga, θ and ϕ are set to satisfy the following relationships (formulas).

$$0<\phi(360-\theta) \quad (2.4)$$

$$\phi=180-\theta/2 \quad (2.1)$$

$$S=\{n+[(\theta/2)/360]\}\times G(n\text{:integer}) \quad (2.5)$$

$$S=m\times Ga(m\text{:integer}) \quad (2.6)$$

Further, in the case where an interval between the exposure times (TM-TY) in the image formation performed in association with the two colors (Y, M) when the driving force is divided and transmitted to the photosensitive drums 1Y and 1M is Sa, the parameters Sa, G, Ga, θ and ϕ are set to satisfy the following relationships (formulas).

$$0<\phi(360-\theta) \quad (2.4)$$

$$\phi=180-\theta/2 \quad (2.1)$$

$$Sa=\{n+[(\theta/2)/360]\}\times G(n\text{:integer}) \quad (2.5a)$$

$$Sa=m\times Ga(m\text{:integer}) \quad (2.6a)$$

In this embodiment shown in FIGS. 3(*a*) to 3(*c*), transfer position distance L=56.55 mm, peripheral speed v=100 mm/sec, branch angle θ=90°, and mesh angle ϕ between motor gear MG and gear 18Y=135° are set.

In FIGS. 3(*b*) and 3(*c*), a thin line 31 (31Y, 31M) represents the rotational speed fluctuation of the photosensitive drum 1 (1Y, 1M) due to the rotational speed fluctuation of the branch gear I1. A thin chain line 32 (32Y, 32M) represents the rotational speed fluctuation of the photosensitive drum 1 (1Y, 1M) due to the rotational speed fluctuation of the motor gear MG. A solid line 33 (33Y, 33M) represents total rotational speed fluctuation of the photosensitive drum 1 (1Y, 1M) which is the sum of the rotational speed fluctuation of the branch gear I1 and the rotational speed fluctuation of the motor gear MG.

As shown in FIG. 3(*b*), at the time TY, the rotational speed of the photosensitive drum 1Y by the branch gear I1 and the motor gear MG is fastest, so that the total rotational speed fluctuation of the photosensitive drum 1Y is maximum. On the other hand, as shown in FIG. 3(*c*), at the time (interval) (TH-TY) (sec) at which the intermediary transfer belt 12*a* moves from the transfer position 19Y to the transfer position 19M, the branch gear I1 is set to perform one turn and ½ ((θ/2)/360) turn.

As a result, as shown in FIGS. 3(*b*) and 3(*c*), also at the transfer time TM, the total rotational speed fluctuation of the photosensitive drum 1M is maximum similarly as in the case of the transfer time TY, so that the photosensitive drums 1Y and 1M have the same rotational speed at the transfer times TY and TM.

Also during the exposure, similarly as during the transfer, the color misregistration between the two colors occurring during the exposure can be suppressed. Specifically, an angle from the exposure position, in which the exposure to the laser light 30Y is effected, to the transfer position 19Y and an angle from the exposure position, in which the exposure to the laser light 30M is effected, to the transfer position 19M are set at the same value. For this reason, the rotational speeds of the respective photosensitive drums 1Y and 1M even at the exposure times tY and tM are equal to each other, so that the color misregistration between the two colors occurring during the exposure can be suppressed.

Further, the branch gear I2, the gears 18C and 18K, and the motor gear MG have the same shape and arrangement as those of the branch gear I1, the gears 18Y and 18M and the motor gear BG. Therefore, the branch gear I2 and the gears 18C and 18K are also configured to be in phase with each other so that they have the same phase at a time from passing of the intermediary transfer belt 12*a* through the transfer position 19C to reaching to the transfer position 19K.

To the gears 18Y and 18C, gear phase detection sensors 27 are provided, respectively. The two gear phase detection sensors 27 detect the phases of the gears 18Y and 18C by sensor flags (not shown) provided integrally with the gears 18Y and 18C. Based on this detection result, two motors M1 and M2 are controlled to effect phase alignment of the gears 18Y and 18C. As a result, the two branch gears I1 and I2 are in phase with each other at a time from passing of the intermediary transfer belt 12*a* through the transfer position 19Y to reaching to the transfer position 19C.

In this way, the gears 18Y and 18C can be made in phase with each other at the transfer positions 19Y and 19C. As a result, the form gears 18Y, 18M, 18C and 18K can be in phase with each other at the respective transfer positions 19Y, 19M, 19C and 19K, so that the color misregistration among the four colors occurring during the transfer can be suppressed. Further, similarly as in the color misregistration during the transfer, the rotational speed fluctuations of the four gears 18Y, 18M, 18C and 18K during the respective exposures can be made in phase with each other, so that the color misregistration among the four colors occurring during the exposure can be suppressed.

Here, the time S at which the intermediary transfer belt 12*a* moves between the transfer positions for the two colors satisfy the following formula (2.7):

$$S=L/v \qquad (2.7).$$

Next, the description will be made by using a motor rotational frequency ω, a teeth number ZM of the motor gear MG, and a teeth number ZI of the branch gear I1 shown in Table 2.

TABLE 2

| |
|---|
| ω = 954.93 rpm |
| ZM = 8 |
| ZI = 64 |

From the formula (2.7), S is obtained as follows: S=L/v=56.55/100=0.5655 (sec).

Further, when the teeth number of the upstream side motor gear MG (=the teeth number of the motor M1) is ω (rpm), the period Ga (sec) of the motor gear MG is obtained as follows:

$$Ga=1/(\omega/60)=1/(954.93/60)=1/15.9155=0.06823\approx 0.0682(\text{sec}).$$

Further, a reduction ratio between the motor gear MG and the branch gear I1 is ZI/ZM, so that the period G of the branch gear I1 is obtained as follows:

$$G=(ZI/ZM)\times Ga=(64/8)\times 0.0628=8\times 0.0628=0.5024 \text{ (sec)}.$$

The branch angle θ is 90° and therefore n can be obtained from the formula (2.5) as follows:

$$S=0.5655=\{n+[(90/2)/360\}\times 0.5024$$

$$0.5655=[n+(1/8)]\times 0.5024$$

$$n=(0.5655/0.5024)-(1/8)=1.000597\approx 1.0$$

Further, m is obtained from the formula (2.6) as follows:

$$S=0.5655=m\times 0.00628$$

$$m=0.5655/0.0628=9.0047\approx 9.0$$

Further, from the formula (2.1), ϕ and θ satisfy:

$$\phi=135(\text{degrees})=180-(90/2)=180-(\theta/2).$$

Further, ϕ and θ also satisfy the condition of the formula (2.4):

$$0<135<270(=360-90),\text{i.e.},0<\phi<(360-\theta).$$

That is, as described above with reference to FIGS. 3(*a*) to 3(*c*), between the transfer time TY to the transfer time TM, the branch gear I1 is set to perform one turn and ⅛ turn, and the motor gear MG is set to perform 9 turns. Further, between the exposure time tY to the exposure time tM (=Sa), the branch gear I1 is set to perform one turn and ⅛ turn, and the motor gear MG is set to perform 9 turns. Further, the branch angle θ and the mesh angle ϕ between the motor gear MG and the gear 18Y are set to satisfy the above-described formulas (2.4) and (2.1).

Incidentally, in this embodiment, the constitution using the intermediary transfer belt 12*a* is described but the present invention is not limited thereto. For example, in place of the intermediary transfer belt 12*a*, it is also possible to employ a constitution in which an electrostatic attraction belt for attracting and conveying the sheet S as a recording material and directly transferring the toner images onto the sheet S.

In this embodiment, similarly as First Embodiment described above, the color misregistration with respect to the drive transmission device is required to be suppressed to a level of about ½ dot at the maximum, i.e., about 20 μm or less in terms of an image resolution of 600 dpi. In this embodiment, as described above, theoretical color misregistration with respect to the drive transmission device is reduced as small as possible by satisfying the following formulas (2.4) and (2.1):

$$0<\phi<(360-\theta) \qquad (2.4),\text{and}$$

$$\phi=180-\theta/2 \qquad (2.1),$$

in which ϕ represents the mesh angle among the motor gear MG, the branch gear I, and the first photosensitive drum gear 18Y and 18C, and θ represents the branch angle. That is, even when the mesh angle ϕ is not 135°, an effect of alleviating the color misregistration is enhanced with a value of the branch angle θ closer to 135°. In this embodiment, it has been theoretically configured that the maximum color misregistration among the four colors is 20 μm or less when the branch angle θ (degrees) is within about ±40°. For this reason, the mesh angle ϕ (degrees) may only be required to be in the range of 95° to 175° with respect to its optimum value of 135°.

Simultaneously, in this embodiment, as described above, the parameter S which is the time of movement of the intermediary transfer belt 12*a* at the transfer interval between the transfer positions 19Y and 19M (or 19C and 19K) with respect to the photosensitive drums 1Y and 1M (or 1C and 1K) to which the driving force is divided and transmitted from the branch gear I, the parameter Sa which is the exposure time interval (TM-TY) (or TK-TC) with respect to the photosensitive drums 1Y and 1M (or 1C and 1K), and the parameter θ which is the branch angle satisfy the above-described formulas (2.5), (2.6), (2.5a) and (2.6a). That is, the theoretical color misregistration with respect to the drive transmission device is reduced as small as possible by satisfying the following formulas:

$$S=\{n+[(\theta/2)/360\}\times G(n:\text{integer}) \qquad (2.5),$$

$$S=m\times Ga(m:\text{integer}) \qquad (2.6),$$

$$Sa=\{n+[(\theta/2)/360\}\times G(n:\text{integer}) \qquad (2.5a),$$

and $$Sa=m\times Ga(m:\text{integer}) \qquad (2.6a).$$

That is, even when the branch angle θ is not 90°, an effect of alleviating the color misregistration is enhanced with a value of the branch angle θ closer to 90°. In this embodiment, it has been theoretically configured that the maximum color misregistration among the four colors is 20 μm or less when the branch angle θ (degrees) is within about ±32°. For this reason, the effect of the present invention is achieved when the branch angle θ (degrees) is in the range of 58° to 122° with respect to its optimum value of 90°. Similarly, even when the above-described relationship is not established by the parameters S, Sa, ϕ, θ, G, Ga, m and n to some extent, the color misregistration with respect to the drive transmission device may only be required to be about 20 μm or less.

Further, the above-described method is the best method for alleviating the color misregistration. The present invention is not limited thereto. In this embodiment, the color misregistration can be alleviated by employing the following method. That is, in FIG. 5(*b*) showing the speed fluctuations 52Y and 52M of the photosensitive drum gears 18Y and 18M, respectively, a difference between a speed fluctuation value of the speed fluctuation 52Y at the transfer time TY and a speed fluctuation value of the speed fluctuation 52M at the transfer time TM is dVT. Further, maximum values of the amplitudes of the speed fluctuations 52Y and 52M are $VY_{MAX}$ and $VM_{MAX}$, respectively. In this case, the mesh angle ϕ, the branch angle θ, the time S of movement of the intermediary transfer belt 2*a* at the transfer position distance L between the transfer positions for the two colors Y and M, and the period G of the branch gear are set so that the values dVT, $VY_{MAX}$ and $VM_{MAX}$ satisfy the formula (2.8):

$$dVT \leqq (VY_{MAX}+VM_{MAX})/2 \quad (2.8).$$

By this setting, the color misregistration can be alleviated.

Third Embodiment

Figure 8:
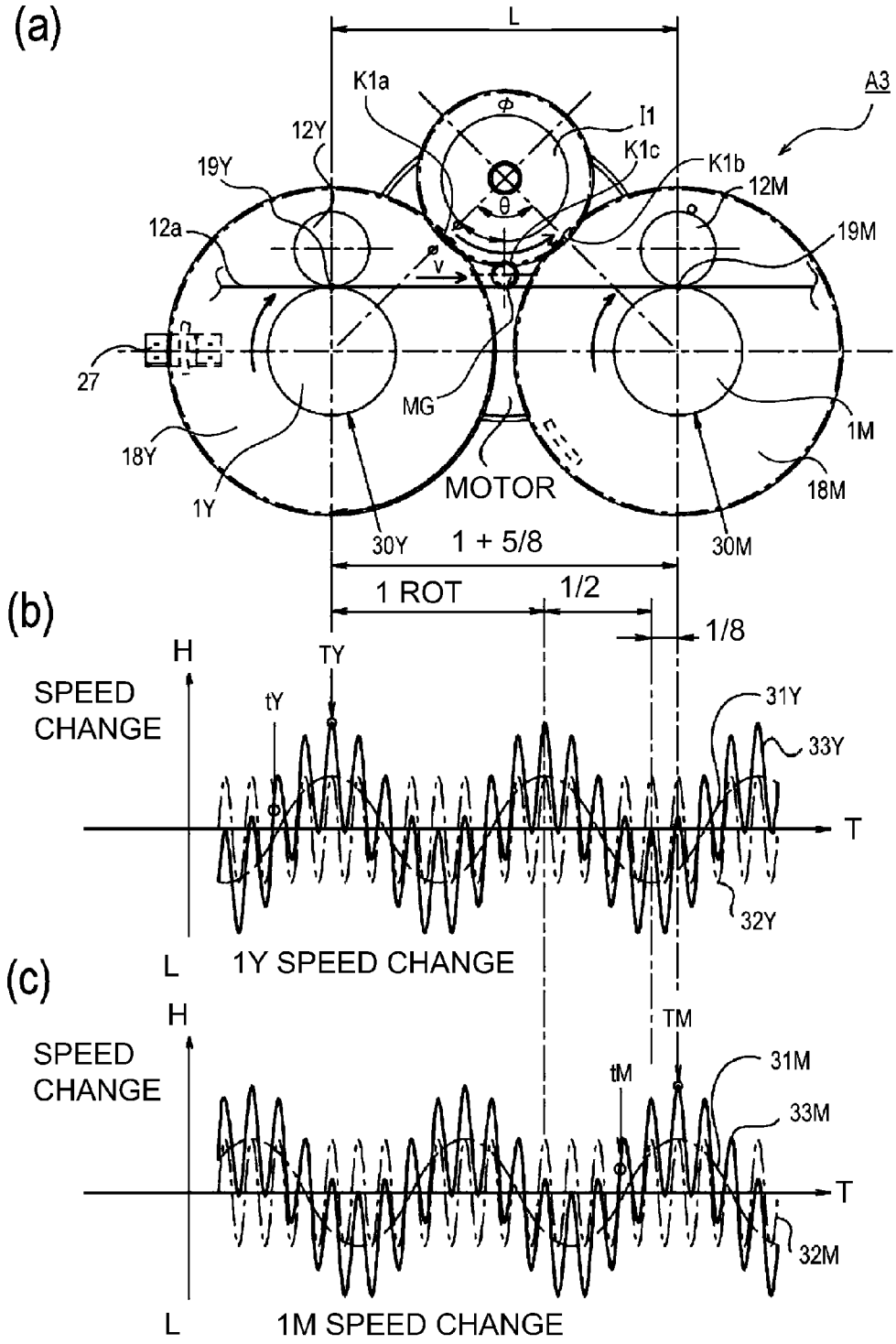
FIG. 8(*a*) is an illustration of a drive transmission device and a primary transfer portion of an image forming apparatus according to Third Embodiment, FIG. 8(*b*) is a schematic view showing rotational speed fluctuation of a photosensitive drum 1Y due to rotational speed fluctuation of a branch gear I1 and a motor gear MG, each transfer time (TY, TM), and each exposure time (tY, tM), and FIG. 8(*c*) is a schematic view showing rotational speed fluctuation of a photosensitive drum 1M due to rotational speed fluctuation of the branch gear I and the motor gear MG, each transfer time (TM, TY) and each exposure time (tM, tY).

Next, Third Embodiment of the image forming apparatus according to the present invention will be described with reference to the drawings. In this embodiment, the method of alleviating the color misregistration between the two colors in the case where the mesh angle ϕ is set to satisfy the formula (2.2), i.e., ϕ=360−θ2 in <Design condition 1> in Second Embodiment will be described. Portions identical to those in First Embodiment will be omitted from redundant description by adding the same reference numerals or symbols. FIG. 8(*a*) is an illustration of the drive transmission device and the primary transfer portion of the image forming apparatus in this embodiment. FIG. 8(*b*) is a schematic view showing rotational speed fluctuation of a photosensitive drum 1Y due to rotational speed fluctuation of a branch gear I1 and a motor gear MG, each transfer time (TY, TM), and each exposure time (tY, tM). FIG. 8(*c*) is a schematic view showing rotational speed fluctuation of a photosensitive drum 1M due to rotational speed fluctuation of the branch gear I and the motor gear MG, each transfer time (TM, TY) and each exposure time (tM, tY).

As shown in FIG. 8(*a*), a drive transmission device A3 of the image forming apparatus according to this embodiment is constituted by changing the arrangement of the motor gear MG and the motor M1 in the drive transmission device A2 in Second Embodiment. Incidentally, the branch gear I2, the gears 18C and 18K, the motor gear MG, and a motor M2 have the same constitution as the branch gear I1, the gears 18Y and 18M, the motor gear MG, and the motor M1, thus being omitted from explanation.

The distances between the transfer positions 19Y and 19M, between the transfer positions 19M and 19C, and between the transfer positions 19C and 19K are set at L (mm). The intermediary transfer belt 12*a* and the photosensitive drum 1 (1Y, 1M, 1C, 1K) are rotated at a peripheral speed v (mm/sec).

The branch gear I1 is rotated at the speed with the period G (sec) and the motor gear MG is rotated at the speed with a period Ga (sec). The adjacent gears 18Y and 18M, to which the driving force is transmitted from the branch gear I1, mesh with the branch gear I1 so as to form branches spaced by the branch gear I1 at the branch angle θ (degrees).

The motor gear MG, the branch gear I1, and the gear 18Y are configured so that an angle when a portion of the branch gear I1 located at a third mesh point K1*c* at which the motor gear MG and the branch gear I1 mesh with each other is rotationally moved on the pitch circle of the branch gear I1 to the first mesh point K1*a* at which the branch gear I1 and the gear 18Y mesh with each other is ϕ (degrees). With respect to the mesh angle ϕ (degrees), a sign of the angle is positive (+) for rotation of the branch gear I1 in a direction from the upstream mesh point K1*c* to the downstream mesh point K1*a* (in the counterclockwise rotational direction of the branch gear I1 in FIG. 8(*a*)).

In the case where the mesh angle ϕ is set to satisfy the formula (2.2), i.e., ϕ=360−θ2 in <Design condition 1> in Second Embodiment, <Design condition 2> in this embodiment will be described. FIGS. 7(*a*) and 7(*b*) show speed fluctuation (ΔV) of the photosensitive drums 1Y(1C) and 1M(1K) due to the rotational speed fluctuation of the branch gear (I1, I2). A speed fluctuation 50 during the input of the driving force into the branch gear I (during the mesh between the branch gear I and the motor gear MG) is identical in behavior irrespective of the colors of Y and M. The speed fluctuation of the photosensitive drum 1Y during the output of the driving force from the branch gear I is 51Y and the speed fluctuation of the photosensitive drum 1M during the output of the driving force from the branch gear I is 51M. The speed fluctuation 51M is phase delayed with respect to the speed fluctuation 51Y by the branch angle θ, so that the period difference between the speed fluctuation 51Y, and the speed fluctuation 51M before one turn is 360−θ. Further, the mesh angle ϕ=360−θ2 is set, so that the speed fluctuation 50 during the input is located at an intermediate position between those of the speed fluctuations 51Y and 51M. For this reason, both of the period difference between the speed fluctuations 51Y and 50 and the period difference between the speed fluctuations 50 and 51M are 180−θ/2. FIG. 7(*b*) shows the (speed fluctuation) component 52Y obtained by superposing the component 50 during the input and the component 51Y during the output and shows the component 52M obtained by superposing the component 50 during the input and the component 51M during the output. Therefore, the phase difference between the component 51Y during the output and the component 52Y obtained by superposing the component 50 during the input and the component 51Y during the output is 90−θ/4. Similarly, the phase difference between the component 51M during the output and the component 52M obtained by superposing the component 50 during the input and the component 51M during the output is 90−θ/4. Therefore, it is understood that the phase delay of the speed fluctuation 52Y with respect to the speed fluctuation 52M for the two colors is: (360−θ)−{(90−θ/4)+(90−θ/4)}=180−θ2. That is, the phase difference between the speed fluctuation 52Y, during first-time rotation when the mesh point between the branch gear I and the motor gear MG is a start position of the rotation of the branch gear I, and the speed fluctuation 52M during second-time rotation (the phase delay of the speed fluctuation 52M with respect to the speed fluctuation 52Y) is 360−(180−θ/2) =180+θ/2.

That is, when the mesh angle ϕ is ϕ=360−θ/2, the color misregistration between the two colors of Y and M can be alleviated by a combination of integer-time rotation, 180°-rotation, and θ/2 rotation of the branch gear I at the time of movement of the intermediary transfer belt 21*a* at the transfer position distance between the transfer positions for the two colors of Y and M. In other words, the color misregistration the two colors of Y and M can be alleviated when both of the following formulas (2.2) and (3.1) are satisfied.

$$\phi=360-\theta/2 \quad (2.2),\text{and}$$

$$L/v=\{n+\tfrac{1}{2}t(\theta/2)/360\}\times G \quad (3.1),$$

in which n is an integer of 0 or more (0, 1, 2, . . . ), it is possible to alleviate the color misregistration between the two colors of Y and M. Incidentally, also during the exposure, the color misregistration between the two colors occurring during the exposure can be alleviated when the time L/v at which the intermediary transfer belt 12*a* moves the distance L between the transfer positions for the two colors of Y and M is replaced, in the formula (3.1), with an interval Sa between exposure times for the two colors (Y, M).

Next, the description will be made based on specific numerical values.

When a time of movement of the intermediary transfer belt 12*a* at the interval between the transfer positions 19Y and 19M, for the two colors, to which the divided driving forces are transmitted from the branch gear I1 is S (=L/v) (sec), the parameters S, G, Ga, θ and ϕ are set to satisfy the following relationships (formulas).

$$(360-\theta)<\phi<360) \quad (2.4)$$

$$\phi=360-\theta/2 \quad (2.2)$$

$$S=\{n+[\tfrac{1}{2}+(\theta/2)/360]\}\times G(n\text{:integer}) \quad (3.3)$$

$$S=m\times Ga(m\text{:integer}) \quad (3.4)$$

Further, when an interval between the exposure times (TM−TY) for the two colors (Y, M) when the driving force is divided and transmitted to the photosensitive drums 1Y and 1M is Sa, the parameters Sa, G, Ga, θ and ϕ are set to satisfy the following relationships (formulas).

$$(360-\theta)<\phi<360 \quad (3.2)$$

$$\phi=360-\theta 2 \quad (2.2)$$

$$Sa=\{n+[\tfrac{1}{2}+(\theta/2)/360]\}\times G(n\text{:integer}) \quad (2.5a)$$

$$Sa=m\times Ga(m\text{:integer}) \quad (3.4a)$$

The sign of the angle is positive (+) when the branch gear I1 is rotated in the counterclockwise direction.

In this embodiment shown in FIGS. 8(*a*) to 8(*c*), transfer position distance L=64.805 mm, peripheral speed v=100 mm/sec, branch angle θ=90°, and mesh angle ϕ between motor gear MG and first gear 18Y=315° are set.

In FIGS. 3(*b*) and 3(*c*), the ordinate represents the rotational speed fluctuation of the photosensitive drum 1 and the abscissa represents each transfer time and each exposure time with respect to the photosensitive drums 1Y and 1M. Further, a thin line 31 (31Y, 31M) represents the rotational speed fluctuation of the photosensitive drum 1 (1Y, 1M) due to the rotational speed fluctuation of the branch gear I1. A thin chain line 32 (32Y, 32M) represents the rotational speed fluctuation of the photosensitive drum 1 (1Y, 1M) due to the rotational speed fluctuation of the motor gear MG. A solid line 33 (33Y, 33M) represents total rotational speed fluctuation of the photosensitive drum 1 (1Y, 1M) which is the sum of the rotational speed fluctuation of the branch gear I1 and the rotational speed fluctuation of the motor gear MG.

As shown in FIG. 8(*b*), at the time TY, the rotational speed of the photosensitive drum 1Y by the branch gear I1 and the motor gear MG is fastest, so that the total rotational speed fluctuation of the photosensitive drum 1Y is maximum. On the other hand, as shown in FIG. 8(*c*), at the time (interval) (TH−TY) (sec) at which the intermediary transfer belt 12*a* moves from the transfer position 19Y to the transfer position 19M, the branch gear I1 is set to perform one turn and 5/2 turn.

As a result, as shown in FIGS. 8(*b*) and 8(*c*), also at the transfer time TM, the total rotational speed fluctuation of the photosensitive drum 1M is maximum similarly as in the case of the transfer time TY, so that the photosensitive drums 1Y and 1M have the same rotational speed at the transfer times TY and TM.

Also during the exposure, similarly as during the transfer, the color misregistration between the two colors occurring during the exposure can be suppressed. Specifically, an angle from the exposure position, in which the exposure to the laser light 30Y is effected, to the transfer position 19Y and an angle from the exposure position, in which the exposure to the laser light 30M is effected, to the transfer position 19M are set at the same value. For this reason, the rotational speeds of the respective photosensitive drums 1Y and 1M even at the exposure times tY and tM are equal to each other, so that the color misregistration between the two colors occurring during the exposure can be suppressed.

Further, the branch gear I2, the gears 18C and 18K, and the motor gear MG have the same shape and arrangement as those of the branch gear I1, the gears 18Y and 18M and the motor gear BG. Therefore, the branch gear I2 and the gears 18C and 18K are also configured to be in phase with each other so that they have the same phase at a time from passing of the intermediary transfer belt 12*a* through the transfer position 19C to reaching to the transfer position 19K.

To the gears 18Y and 18C, gear phase detection sensors 27 are provided, respectively. The two gear phase detection sensors 27 detect the phases of the gears 18Y and 18C by sensor flags (not shown) provided integrally with the gears 18Y and 18C. Based on this detection result, two motors M1 and M2 are controlled to effect phase alignment of the gears 18Y and 18C. As a result, the two branch gears I1 and I2 are in phase with each other at a time from passing of the intermediary transfer belt 12*a* through the transfer position 19Y to reaching to the transfer position 19C.

In this way, the gears 18Y and 18C can be made in phase with each other at the transfer positions 19Y and 19C. As a result, the form gears 18Y, 18M, 18C and 18K can be in phase with each other at the respective transfer positions 19Y, 19M, 19C and 19K, so that the color misregistration among the four colors occurring during the transfer can be suppressed. Further, similarly as in the color misregistration during the transfer, the rotational speed fluctuations of the four gears 18Y, 18M, 18C and 18K during the respective exposures can be made in phase with each other, so that the color misregistration among the four colors occurring during the exposure can be suppressed.

Here, the time S at which the intermediary transfer belt 12*a* moves between the transfer positions for the two colors satisfy the following formula (2.7):

$$S=L/v \quad (3.5).$$

Next, the description will be made by using a motor rotational frequency ω, a teeth number ZM of the motor gear MG, and a teeth number ZI of the branch gear I1 shown in Table 3.

TABLE 3

| |
|---|
| ω = 1203.609 rpm |
| ZM = 8 |
| ZI = 64 |

From the formula (3.5), S is obtained as follows: S=L/v=64.805/100=0.64805≈0.6481 (sec).

Further, when the teeth number of the upstream side gear (=the teeth number of the motor) is ω (rpm), the period Ga (sec) of the motor gear MG is obtained as follows:

$$Ga=1/(\omega/60)=1/(1203.609/60)=1/20.0622=0.04985\approx 0.0499(\text{sec}).$$

Further, a reduction ratio between the motor gear MG and the branch gear I1 is ZI/ZM, so that the period G of the branch gear I1 is obtained as follows:

$$G=(ZI/ZM)\times Ga=(64/8)\times 0.0499=8\times 0.0499=0.3992\ (\text{sec}).$$

The branch angle θ is 90° and therefore n can be obtained from the formula (3.3) as follows:

$$S=0.6481=\{n+[1/2+(90/2)/360\}\times 0.3992$$

$$0.6481=[n+(5/8)]\times 0.3992$$

$$n=(0.6481/0.3992)-(5.8)=0.998496\approx 1.0$$

Further, m is obtained from the formula (3.4) as follows:

$$S=0.6481=m\times 0.0499$$

$$m=0.6481/0.0499=12.98797\approx 13$$

Further, from the formula (2.2), φ and θ satisfy:

$$\phi=315(\text{degrees})=360-(90/2)=360-(\theta/2).$$

Further, φ and θ also satisfy the condition of the formula (3.2):

$$270(=360-90)<315<360,\text{i.e.},(360-\theta)<\phi<360.$$

That is, as described above with reference to FIGS. 8(*a*) to 8(*c*), between the transfer time TY to the transfer time TM, the branch gear I1 is set to perform one turn and ⅝ turn, and the motor gear MG is set to perform 13 turns. Further, between the exposure time tY to the exposure time tM (=Sa), the branch gear I1 is set to perform one turn and ⅝ turn, and the motor gear MG is set to perform 13 turns. Further, the branch angle θ and the mesh angle φ between the motor gear MG and the gear 18Y are set to satisfy the above-described formulas (3.2) and (2.2).

Incidentally, in this embodiment, the constitution using the intermediary transfer belt 12*a* is described but the present invention is not limited thereto. For example, in place of the intermediary transfer belt 12*a*, it is also possible to employ a constitution in which an electrostatic attraction belt for attracting and conveying the sheet S as a recording material and directly transferring the toner images onto the sheet S.

In this embodiment, similarly as First Embodiment and Second Embodiment described above, the color misregistration with respect to the drive transmission device is required to be suppressed to a level of about ½ dot at the maximum, i.e., about 20 μm or less in terms of an image resolution of 600 dpi. In this embodiment, as described above, theoretical color misregistration with respect to the drive transmission device is reduced as small as possible by satisfying the following formulas (3.2) and (2.2):

$$0<\phi<(360-\theta) \quad (3.2),\text{and}$$

$$\phi=180-\theta/2 \quad (2.2),$$

in which φ represents the mesh angle among the motor gear MG, the branch gear I, and the first photosensitive drum gear 18Y and 18C, and θ represents the branch angle. As a result, in this embodiment, the range of the branch angle θ (degrees) at which the color misregistration among the four colors is 20 μm or less is within about ±21°. For this reason, the effect of the present invention is achieved when the mesh angle φ (degrees) is in the range of 294° to 336° with respect to its optimum value of 315°.

Simultaneously, in this embodiment, as described above, the parameter S which is the time of movement of the intermediary transfer belt 12*a* at the transfer interval between the transfer positions 19Y and 19M (or 19C and 19K) with respect to the photosensitive drums 1Y and 1M (or 1C and 1K) to which the driving force is divided and transmitted from the branch gear I, the parameter Sa which is the exposure time interval (TM-TY) (or TK-TC) with respect to the photosensitive drums 1Y and 1M (or 1C and 1K), and the parameter θ which is the branch angle satisfy the above-described formulas (3.3), (3.4), (3.3a) and (3.4a). That is, the theoretical color misregistration with respect to the drive transmission device is reduced as small as possible by satisfying the following formulas:

$$S=\{n+[1/2+(\theta/2)/360\}\times G(n:\text{integer}) \quad (2.5),$$

$$S=m\times Ga(m:\text{integer}) \quad (3.4),$$

$$Sa=\{n+[1/2+(\theta/2)/360\}\times G(n:\text{integer}) \quad (3.3a),$$

and $$Sa=m\times Ga(m:\text{integer}) \quad (3.4a).$$

That is, even when the branch angle θ is not 90°, an effect of alleviating the color misregistration is enhanced with a value of the branch angle θ closer to 90°. In this embodiment, it has been theoretically configured that the maximum color misregistration among the four colors is 20 μm or less when the branch angle θ (degrees) is within about ±103°. For this reason, the effect of the present invention is achieved when the branch angle θ (degrees) is in the range of −13° (347°) to 193° with respect to its optimum value of 90°. Similarly, even when the above-described relationship is not established by the parameters S, Sa, φ, θ, G, Ga, m and n to some extent, the color misregistration with respect to the drive transmission device may only be required to be about 20 μm or less.

Fourth Embodiment

Figure 9:
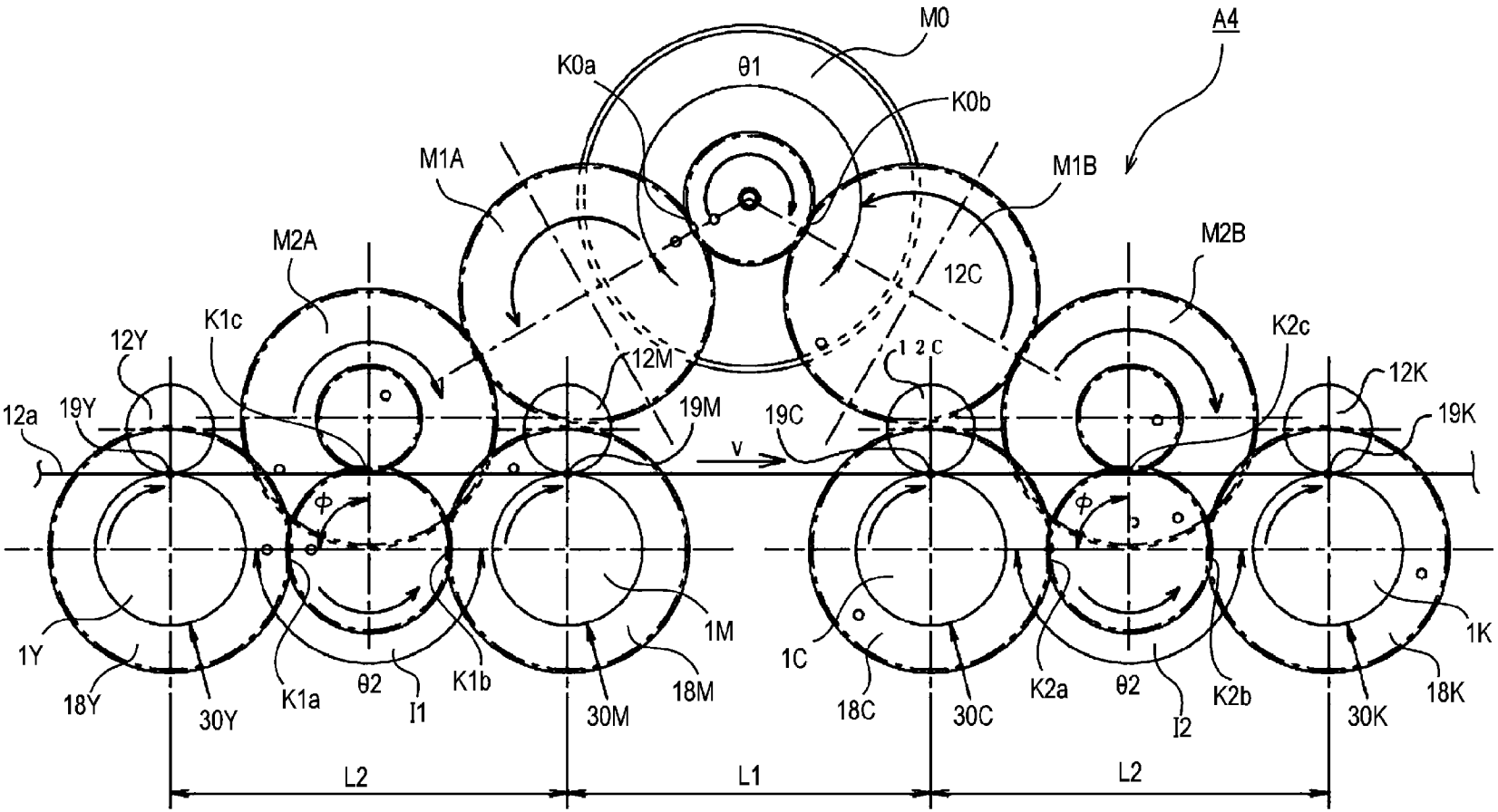
FIG. 9 is an illustration of a drive transmission device and a primary transfer portion of an image forming apparatus according to Fourth Embodiment.
Figure 10:
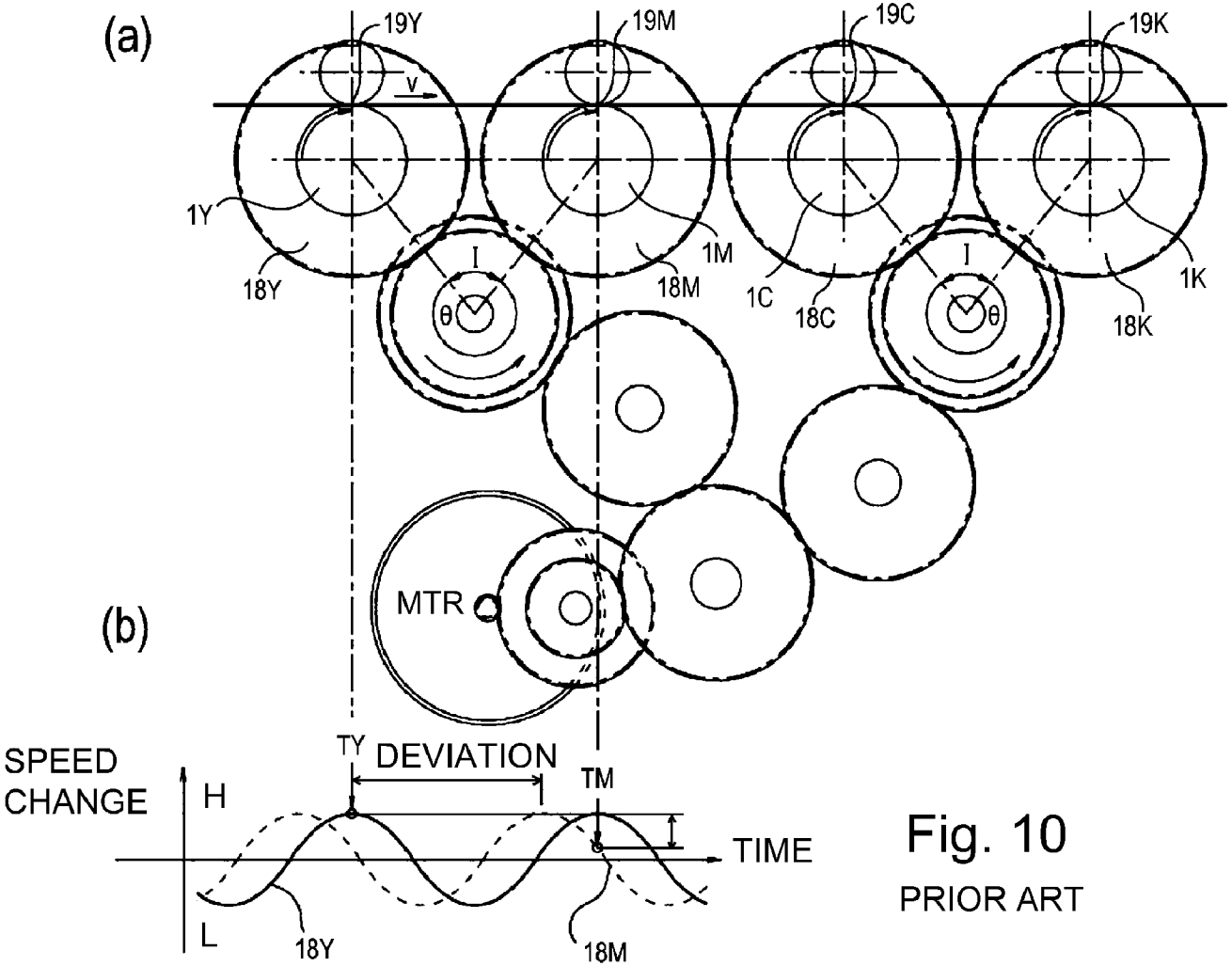
Fig. 10 PRIOR ART
FIG. 10(*a*) is a schematic sectional view of a drive transmission device and a primary transfer portion of a conventional color image forming apparatus.

Next, Fourth Embodiment of the image forming apparatus according to the present invention will be described with reference to the drawings. Portions identical to those in First Embodiment will be omitted from redundant description by adding the same reference numerals or symbols. FIG. 9 is an illustration of the drive transmission device and the primary transfer portion of the image forming apparatus in this embodiment.

As shown in FIG. 9, a drive transmission device A4 of the image forming apparatus in this embodiment is a combination of the drive transmission device A1 in First Embodiment with a single motor which is an intensive motor as the driving source, i.e., a so-called one motor system.

A branch gear I0 is integrally provided on the rotation shaft of a motor M and divides the driving force into two driving force components to be transmitted to two idler gears M1A and M1B. The idler gear M1A transmits the driving force (component) to a branch gear I1 through an idler gear M2A constituted by a stepped gear. The idler gear M1B transmits the driving force (component) to a branch gear I2 through an idler gear M2B constituted by a stepped gear.

The branch gear I1 transmits the driving force to gears 18Y and 18M. A relationship among the branch gear I1 and the gears 18Y and 18M is similar to that in First Embodiment, thus being omitted from explanation. The branch gear I2 transmits the driving force to gears 18C and 18K. A relationship among the branch gear I2 and the gears 18C and 18K is similar to that in First Embodiment, thus being omitted from explanation. The distances between the transfer positions 19M and 19C for the two colors is set at L1 (mm). The distances between the transfer positions 19Y and 19M for the two colors and between the transfer positions 19C and 19K for the two colors are set at L2 (mm). The intermediary transfer belt 12*a* and the photosensitive drum 1 (1Y, 1M, 1C, 1K) is rotated at a peripheral speed v (mm/sec).

The branch gear I1 is rotated at the speed with a period G1 (sec), the branch gear 2 is rotated at the speed with a period G2, and the idler gears M2A and M2B are rotated at the speed with a period G2*a* (sec).

The two idler gears M1A and M1B, to which the driving force is to be transmitted from the branch gear I0, mesh with the branch gear I0 so as to form branches spaced by the branch gear I0 at an angle θ1 (degrees). With respect to the angle θ (degrees), a sign of the angle is positive (+) for rotation of the branch gear I0 in a direction from a mesh point K0*a* at which the branch gear I0 meshes with the idler gear M1A to a mesh point K0*b* at which the branch gear I0 meshes with the idler gear M1B (in the clockwise rotational direction of the branch gear I0 in FIG. 9). The gears 18Y and 18M (the gears 18C and 18K) mesh with the branch gear I1 so as to form branches spaced by the branch gear I1 at an angle θ2 (degrees).

With respect to the angle θ2 (degrees), a sign of the angle is positive (+) for rotation of the branch gear I1 (I2) in a direction from a mesh point K1*a* (K2*a*) to a mesh point K1*b* (K2*b*) (in the counterclockwise rotational direction of the branch gear I1 (I2) in FIG. 9).

An angle ϕ (degrees) is formed between a mesh point K1*c* (K2*c*) at which the idler gear M2A (M2B) and the branch gear I1 (I2) mesh with each other and the mesh point K1*a* (K2*a*) at which the branch gear I1 and the gear 18Y (18C) mesh with each other. With respect to the angle ϕ (degrees), a sign of the angle is positive (+) for rotation of the branch gear I1 in a direction from the upstream mesh point K1*c* to the downstream mesh point K1*a* (in the counterclockwise rotational direction of the branch gear I1 in FIG. 9).

The parameters L1, L2, G1, G2, G2*a*, θ1, θ2, and θ are constituted to satisfy the following relationships:

$$0<\phi<(360-\theta 2) \tag{4.0}$$

$$\phi=180-\theta 2/2 \tag{4.1}$$

$$L1/v=(j+\theta 1/360)\times G1(j\text{:integer}) \tag{4.2}$$

$$L2/v=n\times G1(n\text{:integer}) \tag{4.3}$$

$$L2/v=\{m+[(\theta 2/2)/360)\}\times G2(m\text{:integer}) \tag{4.4}$$

$$L2/v=k\times G2a(k\text{:integer}) \tag{4.5}$$

Hereinafter, the description will be made more specifically with reference to specific numerical values. The motor rotational frequency is ω (rpm). The teeth number of the branch gear I0 is ZI1. The teeth number of the branch gears I1 and I2 is ZI2. The teeth number of the idler gears MIA and M1B is ZM1. The teeth number of large gears of the idler gears M2A and M2B is ZML. The teeth number of small gears of the idler gears M2A and M2B is ZMS. The specific values of the above parameters are shown in Table 4 below together with these of the parameters v, L1, L2, θ1, θ2 and ϕ.

TABLE 4

| |
|---|
| v (mm/sec) = 100 |
| L1 (mm) = 58.202 |
| L2 (mm) = 63.65 |
| θ1 (degrees) = 240 |
| θ2 (degrees) = 180 |
| ϕ (degrees) = 90 |
| ω (rpm) = 377.993 |
| ZI1 = 40 |
| ZI2 = 51 |
| ZM1 = 80 |
| ZML = 80 |
| ZMS = 32 |

The rotational speed fluctuations of the respective photosensitive drums are similar to those described in First Embodiment, so that the drawings showing the rotational speed fluctuations and detailed description thereof will be omitted. In this embodiment, a difference of this embodiment from the above-described embodiments will be described based on specific values of other parameters such as G1, G2, G2*a*, and the like.

The period G1 (sec) of the branch gear I0 is obtained by using the rotational frequency ω (rpm) of the branch gear I0 (by using the motor rotational frequency) as follows:

$$G1=1/(\omega/60)=1/(377.993/60)=1/6.2999=0.1587331\approx 0.1587(\text{sec}).$$

A reduction ratio between the idler gear M1A (M1B) and the branch gear I0 is ZM1/ZI1 and therefore the period G1*a* of the idler gear M1A (M1B) is obtained as follows:

$$G1a=(ZM1/ZI1)\times G1=(80/40)\times 0.1587=2\times 0.1587=0.3174(\text{sec}).$$

The idler gear M1A (M1B) meshes with the large gear of the idler gear M2A (M2B) and ZM1=ZML is satisfied from Table 4, so that the period G2*a* of the idler gear M2A (M2B) is:

$$G2a=G1a=0.3174(\text{sec}).$$

The branch gear I2 meshes with the small gear of the idler gear M2A (M2B) and the reduction ratio between the branch gear I2 and the idler gear M2A (M2B) is ZI2/ZMS, so that the period G2 of the branch gear I2 is obtained as follows:

$$G2=(ZI2/ZMS)\times G2a=(51/32)\times 0.3174=1.5938\times 0.3174=0.5059(\text{sec}).$$

The branch angle θ1 of the branch gear I0 is 240° (Table 4). The integer j in the formula (3.2) is obtained as follows:

$$L1/v=(j+\theta 1/360)\times G1$$

$$58.202/100=(j+240/360)\times 0.1587$$

$$j=80.48202/0.1587)-2/3=3.66742-0.66666=3.000762\approx 3.0.$$

The integer n in the formula (4.3) is obtained as follows:

$$L2/v=n\times G1$$

$$63.65/100=n\times 0.1587$$

$$n=0.6365/0.1587=4.0107\approx 4.0.$$

The integer m in the formula (4.4) is obtained as follows:

$$L2/v=\{m+[(\theta 2/2)/360]\}\times G2$$

$$63.65/100=\{m+[(180/2)/360\}\times 0.5059$$

$$m+(180/720)=0.6365/0.5059$$

$$m=(0.6365/0.5059)-1/4=1.25815-0.25=1.00815\approx 1.0.$$

The integer k in the formula (4.5) is obtained as follows:

$$L2/v=k\times G2a$$

$$63.65/100=k\times 0.3174$$

$$k=0.6365/0.3174=2.00535\approx 2.0.$$

From the formula (4.1), the relationship between the angles ϕ and θ2 is:

$$\phi=90(\text{degrees})=180-(180/2)=180-(\theta 2/2).$$

Therefore, the angles ϕ and θ2 satisfy the condition of the formula (4.):

$$0<90<180(=360-180),\text{i.e.},0<\phi<(180-\theta 2).$$

That is, as described above with reference to FIG. 9, the mesh angle ϕ is set at 180−θ2/2,and the branch gear I0 is set so as to perform 3 turns and θ2 (180° turn at an interval (TC-TM) at which the intermediary transfer belt 12*a* passes through the transfer position distance L1 between the transfer positions for the two colors. Further, the branch gear I0 is set so as to perform 4 turns at an interval (TM−TY or TK−TC) at which the intermediary transfer belt 12*a* passes through the transfer position distance L2 between the transfer positions for the two colors. Further, the idler gears M2A and M2B are set so as to perform 2 turns at intervals (TM−TY and TK−TC) at which the intermediary transfer belt 12*a* passes through the transfer position distance L2 between the transfer positions for the two colors. Further, the branch gears I1 and I2 are set so as to perform one turn and ½ turn of the branch angle θ2 (i.e., 90°-turn) at the intervals (TM−TY and TK−TC) at which the intermediary transfer belt 12*a* passes through the transfer position distance L2 between the transfer positions for the two colors. As a result, the speed fluctuations of the photosensitive drums 1 (1Y, 1M, 1C and 1K) during the transfer for the four colors can be made identical to each other, so that the color misregistration among the four colors can be suppressed.

On the other hand, also during the exposure for the four colors, the branch gear I0 is configured to perform 3 turns and 180°-turn (which is the branch angle turn of the branch gear I0) at an interval between exposure times tM and tC. Further, at an interval between exposure times tY and tM and at an interval between exposure times tC and tK, the branch gear I0 is configured to perform 4 turns and the idler gears M2A and M2B are configured to perform 2 turns. Further, the branch gears I1 and I2 are configured to perform one turn and ½ turn of the branch angle θ2 (i.e., 90°-turn) at the intervals between the exposure times tY and tM and between the exposure times tC and tK. As a result, the speed fluctuations of the photosensitive drums 1 (1Y, 1M, 1C and 1K) during the transfer for the four colors can be made identical to each other, so that the color misregistration among the four colors can be suppressed.

That is, in this embodiment, the so-called one motor-type drive transmission device A4 is used and is realized by a combination of the four gears 18Y, 18M, 18C and 18K, the branch gears I1 and I2, the idler gears M2A and M2B, the idler gears M1A and M1B, and the branch gear I0 which are phase aligned. Therefore, in this embodiment, there is no need to align the gear phase between the two motors by phase detection and control by using the gear phase detecting sensors 27, different from the above-described First to Third Embodiments using the two motor-type drive transmission devices A1 to A3. Thus, in this embodiment, there is no need to provide the gear phase detecting sensor 27, a control device, and the like, so that cost reduction can be realized.

Further, in this embodiment, the angles ϕ and θ2 are set to satisfy the formulas (4.0) and (4.1) but may also be satisfy the following formulas (4.0a) and (4.1a):

$$(360-\theta 2)<\phi<360 \quad (4.0a),\text{and}$$

$$\phi=360-\theta 2/2 \quad (4.1a).$$

In this case, as described in Third Embodiment, by setting the formula (4.4) satisfy the following formula (4.4a):

$$L2/v=\{m+[1/2+(\theta 2/2)360]\}\times G2(m:\text{integer}) \quad (4.4a),$$

the color misregistration occurring during the transfer for the four colors and during the exposure for the four colors can be suppressed similarly as in Third Embodiment As described above, the gear train is configured so that the parameters v, L1, L2, θ1, θ2, and ϕ satisfy the formulas (4.0) to (4.4a). As a result, even when the rotational speed fluctuations of the branch gears I0, I1 and I2, the idler gears M1A (M1B) and M2A (M2B), and the gears 18 occur due to the eccentricity of the rotation shaft or the like, the rotation speeds of the respective photosensitive drums during the transfer and exposure can be made equal to each other to suppress the color misregistration among the four colors.

Incidentally, in this embodiment, the constitution using the intermediary transfer belt 12*a* is described but the present invention is not limited thereto. For example, in place of the intermediary transfer belt 12*a*, it is also possible to employ a constitution in which an electrostatic attraction belt for attracting and conveying the sheet S as a recording material and directly transferring the toner images onto the sheet S.

In this embodiment, similarly as First Embodiment to Third Embodiments described above, the color misregistration with respect to the drive transmission device is required to be suppressed to a level of about ½ dot at the maximum, i.e., about 20 μm or less in terms of an image resolution of 600 dpi. In this embodiment, as described above, theoretical color misregistration with respect to the drive transmission device is reduced as small as possible by satisfying all the formulas (4.0) to (4.5) or satisfying the formulas (4.0a), (4.1a), (4.2), (4.3), (4.4) and (4.5). However, even when the above-described relationships (formulas) are not established by the parameters v, L1, L2, θ1, θ2, ϕ, j, k, m and n to some extent, the color misregistration with respect to the drive transmission device may only be required to be about 20 μm or less.

While the invention has been described with reference to the structures disclosed herein, it is not confined to the details set forth and this application is intended to cover such modifications or changes as may come within the purpose of the improvements or the scope of the following claims.

This application claims priority from Japanese Patent Application No. 112072/2009 filed May 1, 2009, which is hereby incorporated by reference.

What is claimed is:

1. An image forming apparatus comprising:

a first photosensitive member to be subjected to image formation by exposing to light said first photosensitive member at an exposure position to form a latent image and then by transferring a toner image, formed by developing the latent image with toner, onto a transfer material at a transfer position;

a second photosensitive member to be subjected to image formation by exposing to light said second photosensitive member at an exposure position to form a latent image and then by transferring a toner image, formed by developing the latent image with toner, onto the transfer material at a transfer position;

a first photosensitive member gear provided coaxially and integrally with said first photosensitive member;

a second photosensitive member gear provided coaxially and integrally with said second photosensitive member;

a driving source for rotationally driving said first photosensitive member and said second photosensitive member; and a branch gear, meshable with said first photosensitive member gear at a first mesh point and meshable with said second photosensitive member gear at a second mesh point, for transmitting a driving force from said driving source to said first photosensitive member gear and said second photosensitive member gear, wherein a sum of a time of movement of a portion of said branch gear located at the first mesh point to the second mesh point and a time of integer-time rotation of said branch gear is equal to a time of movement of the transfer material from the transfer position of said first photosensitive member to the transfer position of said second photosensitive member.

2. An apparatus according to claim 1, wherein a time of rotation of said first photosensitive member from the exposure position to the transfer position is equal to a time of rotation of said second photosensitive member from the exposure position to the transfer position.

3. An image forming apparatus comprising:

a first photosensitive member to be subjected to image formation by exposing to light said first photosensitive member at an exposure position to form a latent image and then by transferring a toner image, formed by developing the latent image with toner, onto a transfer material at a transfer position;

a second photosensitive member to be subjected to image formation by exposing to light said second photosensitive member at an exposure position to form a latent image and then by transferring a toner image, formed by developing the latent image with toner, onto the transfer material at a transfer position;

a first photosensitive member gear provided coaxially and integrally with said first photosensitive member;

a second photosensitive member gear provided coaxially and integrally with said second photosensitive member;

a driving source for rotationally driving said first photosensitive member and said second photosensitive member;

a branch gear, meshable with said first photosensitive member gear at a first mesh point and meshable with said second photosensitive member gear at a second mesh point, for transmitting a driving force from said driving source to said first photosensitive member gear and said second photosensitive member gear, and an upstream gear, meshable with said branch gear at a third mesh point, for transmitting the driving force from said driving force, wherein an angle of rotation of said branch gear when a portion of said branch gear located at the first mesh point is moved to the second mesh point, an angle of rotation of said branch gear when a portion of said branch gear located at the third mesh point is moved to the first mesh point, a time of movement of the transfer material from the transfer position of said first photosensitive member to the transfer position of said second photosensitive member, and a period of rotation of said branch gear are set so that a difference dVT between a speed fluctuation value at a transfer time of said first photosensitive member and a speed fluctuation value at a transfer time of said second photosensitive member, a maximum V1max of an amplitude of speed fluctuation of said first photosensitive member, and a maximum V2max of an amplitude of speed fluctuation of said second photosensitive member satisfy:

$$dVT \leqq (V1\max + V2\max)/2.$$

4. An image forming apparatus comprising:

a first photosensitive member to be subjected to image formation by exposing to light said first photosensitive member at an exposure position to form a latent image and then by transferring a toner image, formed by developing the latent image with toner, onto a transfer material at a transfer position;

a second photosensitive member to be subjected to image formation by exposing to light said second photosensitive member at an exposure position to form a latent image and then by transferring a toner image, formed by developing the latent image with toner, onto the transfer material at a transfer position;

a first photosensitive member gear provided coaxially and integrally with said first photosensitive member;

a second photosensitive member gear provided coaxially and integrally with said second photosensitive member;

a driving source for rotationally driving said first photosensitive member and said second photosensitive member;

a branch gear, meshable with said first photosensitive member gear at a first mesh point and meshable with said second photosensitive member gear at a second mesh point, for transmitting a driving force from said driving source to said first photosensitive member gear and said second photosensitive member gear, and an upstream gear, meshable with said branch gear at a third mesh point, for transmitting the driving force from said driving source, wherein an angle θ (degrees) of rotation of said branch gear when a portion of said branch gear located at the first mesh point is moved to the second mesh point, an angle ϕ (degree) of rotation of said branch gear when a portion of said branch gear located at the third mesh point is moved to the first mesh point, a time S (seconds) of movement of the transfer material from the transfer position of said first photosensitive member to the transfer position of said second photosensitive member, and a period G (seconds) of rotation of said branch gear satisfy:

$$\phi = 180 - \theta/2, \text{and}$$

$$S = [n + (\theta/2)/300] \times G (n\text{:integer}).$$

5. An apparatus according to claim 4, wherein when an interval between an exposure time of said first photosensitive member at the exposure position and an exposure time of said second photosensitive member at the exposure position is Sa (seconds) in order that the toner images are to be formed on said first photosensitive member and said second photosensitive member, respectively, and to be superposedly transferred onto the transfer material, $$\phi = 180 - \theta/2, \text{and}$$

$$Sa = [n + (\theta/2)/360] \times G (n\text{:integer})$$

are satisfied.

6. An image forming apparatus comprising:

a first photosensitive member to be subjected to image formation by exposing to light said first photosensitive member at an exposure position to form a latent image and then by transferring a toner image, formed by developing the latent image with toner, onto a transfer material at a transfer position;

a second photosensitive member to be subjected to image formation by exposing to light said second photosensitive member at an exposure position to form a latent image and then by transferring a toner image, formed by developing the latent image with toner, onto the transfer material at a transfer position;

a first photosensitive member gear provided coaxially and integrally with said first photosensitive member;

a second photosensitive member gear provided coaxially and integrally with said second photosensitive member;

a driving source for rotationally driving said first photosensitive member and said second photosensitive member;

a branch gear, meshable with said first photosensitive member gear at a first mesh point and meshable with said second photosensitive member gear at a second mesh point, for transmitting a driving force from said driving source to said first photosensitive member gear and said second photosensitive member gear; and an upstream gear, meshable with said branch gear at a third mesh point, for transmitting the driving force from said driving source, wherein an angle θ (degree) of rotation of said branch gear when a portion of said branch gear located at the first mesh point is moved to the second mesh point, an angle ϕ (degrees) of rotation of said branch gear when a portion of said branch gear located at the third mesh point is moved to the first mesh point, a time S (seconds) of movement of the transfer material from the transfer position of said first photosensitive member to the transfer position of said second photosensitive member, and a period G (seconds) of rotation of said branch gear satisfy:

$$\phi=360-\theta 2,\text{and}$$

$$S=\{n+[1/2+(\theta/2)/300]\}\times G(n:\text{integer}).$$

7. An apparatus according to claim 6, wherein when an interval between an exposure time of said first photosensitive member at the exposure position and an exposure time of said second photosensitive member at the exposure position is Sa (seconds) in order that the toner images are to be formed on said first photosensitive member and said second photosensitive member, respectively, and to be superposedly transferred onto the transfer material, $$\phi=360-\theta/2,\text{and}$$

$$S=\{n+[1/2+(\theta/2)/300]\}\times G(n:\text{integer})$$

are satisfied.

8. An apparatus according to claim 1, wherein said first photosensitive member gear and said second photosensitive member gear have the same shape.

* * * * *